United States Patent [19]

Schmid et al.

[11] 4,127,012

[45] Nov. 28, 1978

[54] STITCH SELECTOR CONTROL MEANS

[76] Inventors: Manfred Schmid, Morikestr. 8, 7445 Bempflingen; Werner Sommer, Kolpingstr. 51, 7300 Esslingen; Antonius Vinnemann, Am Bopserweg 11, 7000 Stuttgart 1, all of Germany

[21] Appl. No.: 777,155

[22] Filed: Mar. 11, 1977

Related U.S. Application Data

[63] Continuation of Ser. No. 705,055, Jul. 14, 1976, abandoned.

[30] Foreign Application Priority Data

Jul. 16, 1975 [DE] Fed. Rep. of Germany ..... 2531762

[51] Int. Cl.[2] ..... D04B 7/00; D04B 15/66

[52] U.S. Cl. ..... 66/75.2; 66/62

[58] Field of Search ..... 66/60, 62, 63, 64, 65, 66/71, 72, 73, 75.1, 75.2, 78

[56] References Cited

U.S. PATENT DOCUMENTS

| | | | |
|---|---|---|---|
| 528,810 | 11/1864 | Salisbury | 66/64 |
| 559,850 | 5/1896 | Johanson | 66/64 |
| 616,600 | 12/1898 | Burson | 66/71 |
| 3,910,071 | 10/1975 | Schieber et al. | 66/64 |

FOREIGN PATENT DOCUMENTS

| | | | |
|---|---|---|---|
| 1,296,733 | 6/1969 | Fed. Rep. of Germany | 66/72 |
| 44,888 | 7/1966 | Fed. Rep. of Germany | 66/64 |
| 493,837 | 5/1954 | Italy | 66/64 |
| 5,702 of | 1893 | United Kingdom | 66/62 |
| 996,125 | 6/1965 | United Kingdom | 66/60 |

*Primary Examiner*—Ronald Feldbaum

[57] ABSTRACT

A knitting machine having a plurality of knitting tools for producing fabrics in accordance with a pattern comprising: a plurality of eccentric cam discs which are arranged with an angular staggered relationship on a driving shaft; a plurality of driving elements being permanently drivingly coupled with an associated one of said cam discs; and a plurality of movable coupling elements, wherein each coupling element may selectively drivingly couple an associated one of said driving elements and an associate one of said knitting tools for selecting said associated knitting tool in accordance with a pattern.

80 Claims, 32 Drawing Figures

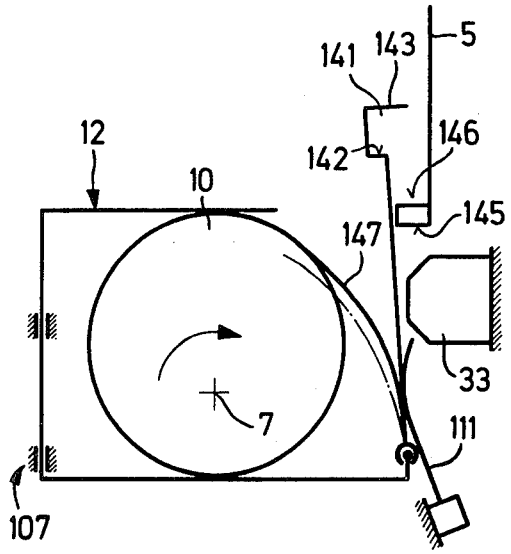
Fig. 29
Fig. 30
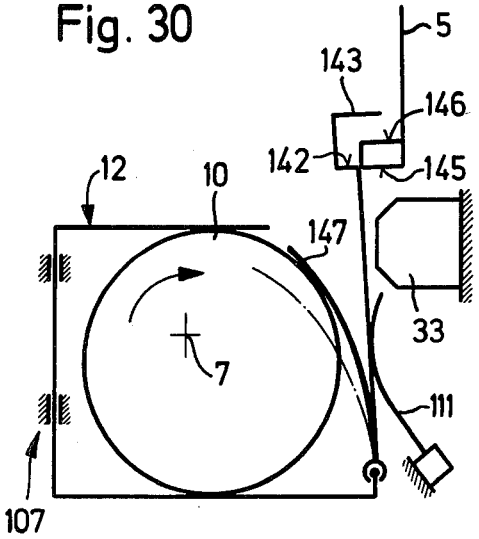
Fig. 31
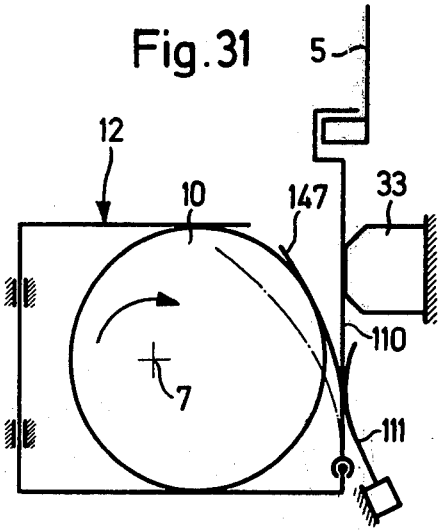

STITCH SELECTOR CONTROL MEANS

This is a continuation, of application Ser. No. 705,055, filed July 14, 1976 now abandoned.

The invention relates to a loop-forming knitting machine having at least one needle bed in the grooves of which at least one knitting tool is slidably mounted, each knitting tool having associated with it an eccentric cam disc producing driving and drawing-down throws, a driving element with at least one raising and one drawing-down portion and adapted to be driven by the cam disc, a coupling element for driving connection of the knitting tool with the driving element and a control device by means of which the coupling elements are controllable according to pattern into at least one coupling position connecting the knitting tool with the driving element and into an uncoupling position, and wherein the cam discs are arranged with an angular staggering on a rotatable driving shaft.

In known knitting machines of this kind (German Laid-open Pending Patent Application 1,585,308), which may also be described as carriageless or lockless knitting machines, the driving elements are in the form of swingably mounted control levers which are forced against the cam discs by springs. This has the resultant disadvantage that the movement of the knitting tools in the direction of the raising of the needles can be produced solely by spring forces and that the driving of the knitting tools in the direction of the drawing-down of the needles which is obtained by means of the cam discs must be effected in opposition to these spring forces. Another disadvantage consists in that after the knitting tools have been raised into the knitting position they must be drawn down completely into the inoperative position, which corresponds to the normal run-through position, before a fresh selection can be carried out by suitable control of the coupling elements, so that only comparatively small intervals of time are available for the selection if stoppage stages or idle lifts of the cam discs are to be avoided. Finally, it is also a disadvantage that only a choice between knit and miss is possible.

The two first-mentioned disadvantages also arise essentially in a similar known knitting machine (German Laid-open Pat. No. 1,296,733; German Laid-open Pending Patent Application 1,635,968). Since, however, the selection is effected in this instance in that the movement of the control levers taking place under the action of spring forces in the direction of the raising of the needles is blocked according to the pattern, a choice between knit and tuck is also possible.

Finally, another known carriageless knitting machine which makes a selection of the knitting needles according to pattern possible (German Laid-open Pending Patent Application 1,585,454) has the disadvantage that those knitting tools which are not to be selected for knitting must be swung transversely of the needle bed until their butts are out of engagement with respective driver pins fixed to the cam discs. A choice between knit and tuck is not possible with this knitting machine.

The object of the invention is to remove the mentioned disadvantages of the described state of the art by providing a new selection system for the knitting tools, this selection system being intended to make possible a choice between miss and knit and, in case of need, also between miss, knit and tuck.

The special problem of the invention consists in so designing a loop-forming machine of the kind mentioned at the beginning that the drive of the knitting tools in both directions is effected with the avoidance of spring forces by driving connection of the knitting tools with the associated cam discs, and that even at high speeds of the cam discs sufficiently large intervals of time are available for selection of the knitting tools according to pattern.

The invention is characterized in that the driving elements and the cam discs are so designed that the driving elements are constantly drivingly coupled with the cam discs in the direction of the raising and drawing-down throws, during the camming-down throws the drawing-down portions produce a drawing down of the knitting tools coupled with the raising portions during the preceding raising throw, irrespective of the instantaneous positions of the coupling elements, and during the camming-down throws all the coupling elements can first be brought into one of the two defined positions and then out of this position according to pattern into the other defined position.

In a preferred constructional form of the invention, all the coupling elements are adapted to be controlled into two coupling positions, one of which corresponds to the knitting position and the other to the tucking position, and into an uncoupling position and, during the drawing-down throws, can be brought first into one of the three positions and then out of this position according to pattern into one of the other two positions.

The invention brings with it the advantage that for the selection of a knitting tool according to pattern a time interval is available which corresponds practically speaking to a complete drawing-down throw, i.e., to about one half of each revolution of a cam disc, without the need during the selection for the driving connection of the knitting tools with the driving elements or their driving connection with the cam discs to be broken or for the driving force provided by the cam discs to be replaced in any direction by a spring force.

Further advantageous features of the invention are described hereinafter.

The invention is described more fully hereinafter with reference to embodiments in association with the accompanying drawings, in which:

FIGS. 26 and 27 to 31 show another two embodiments of the driving and selection system.

Figure 1:
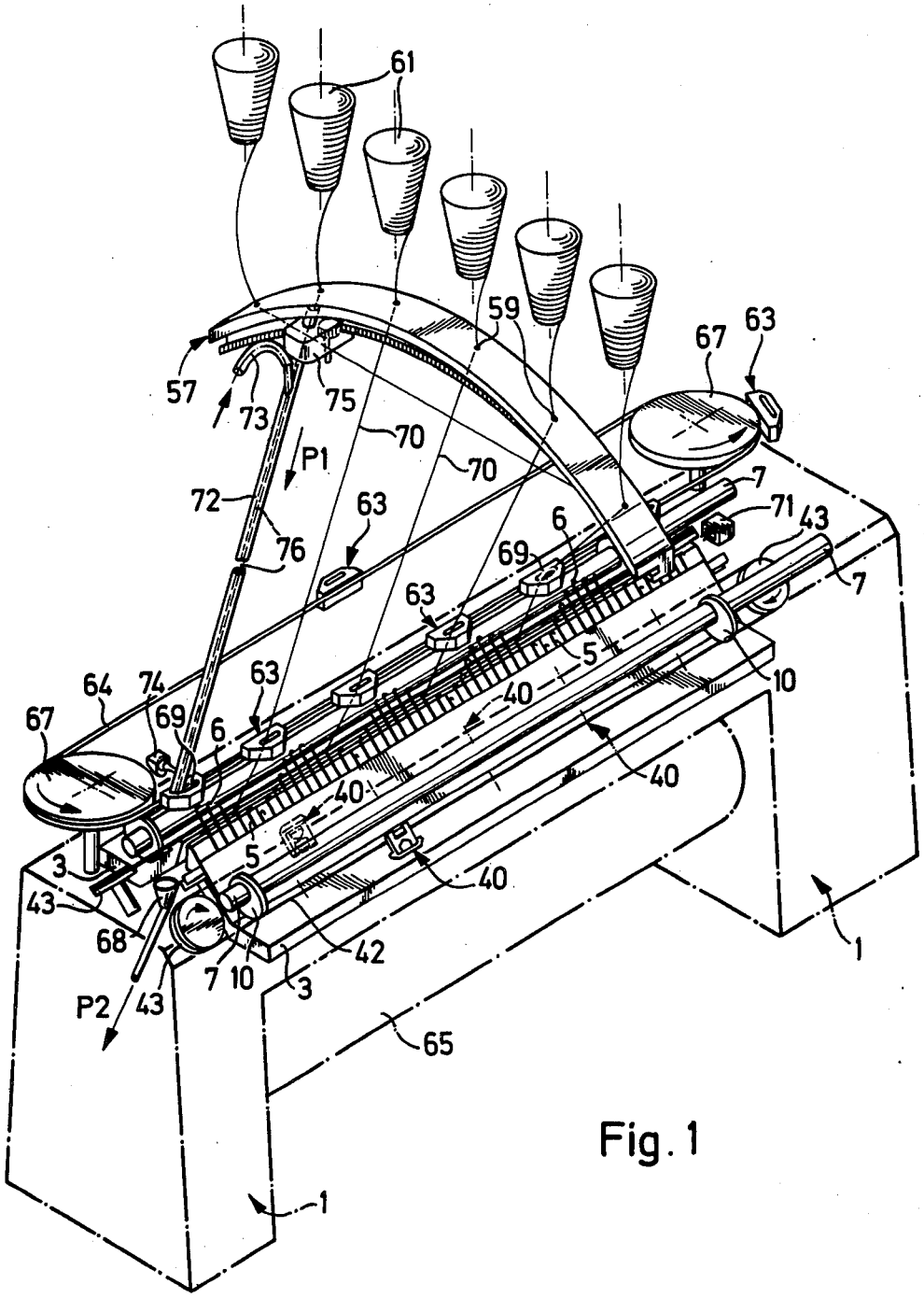
FIG. 1 is a diagrammatic perspective general view of a knitting machine according to the invention.
Figure 2:
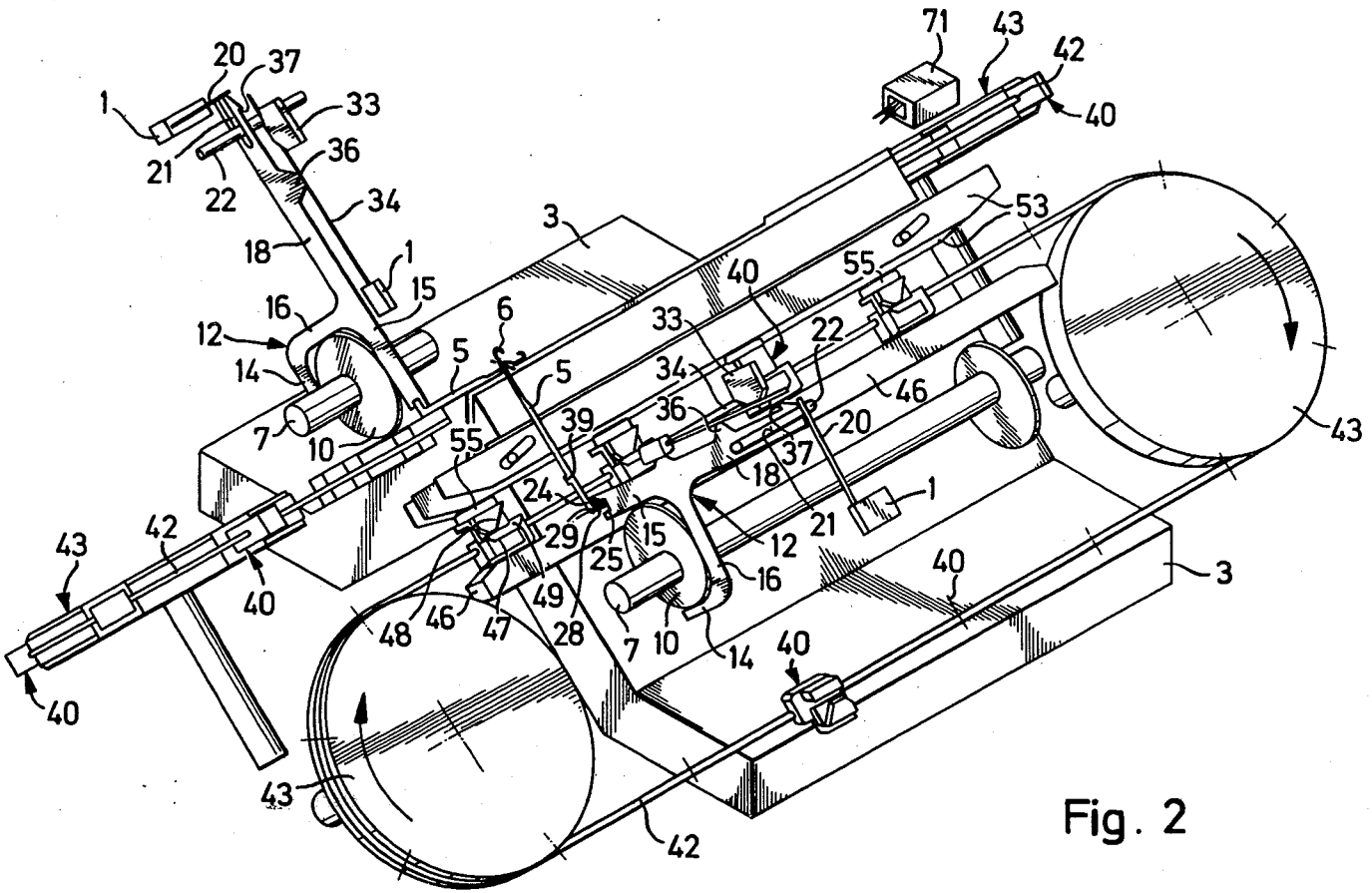
FIG. 2 is a partial view of the knitting machine according to FIG. 1 on a larger scale.
Figure 3:
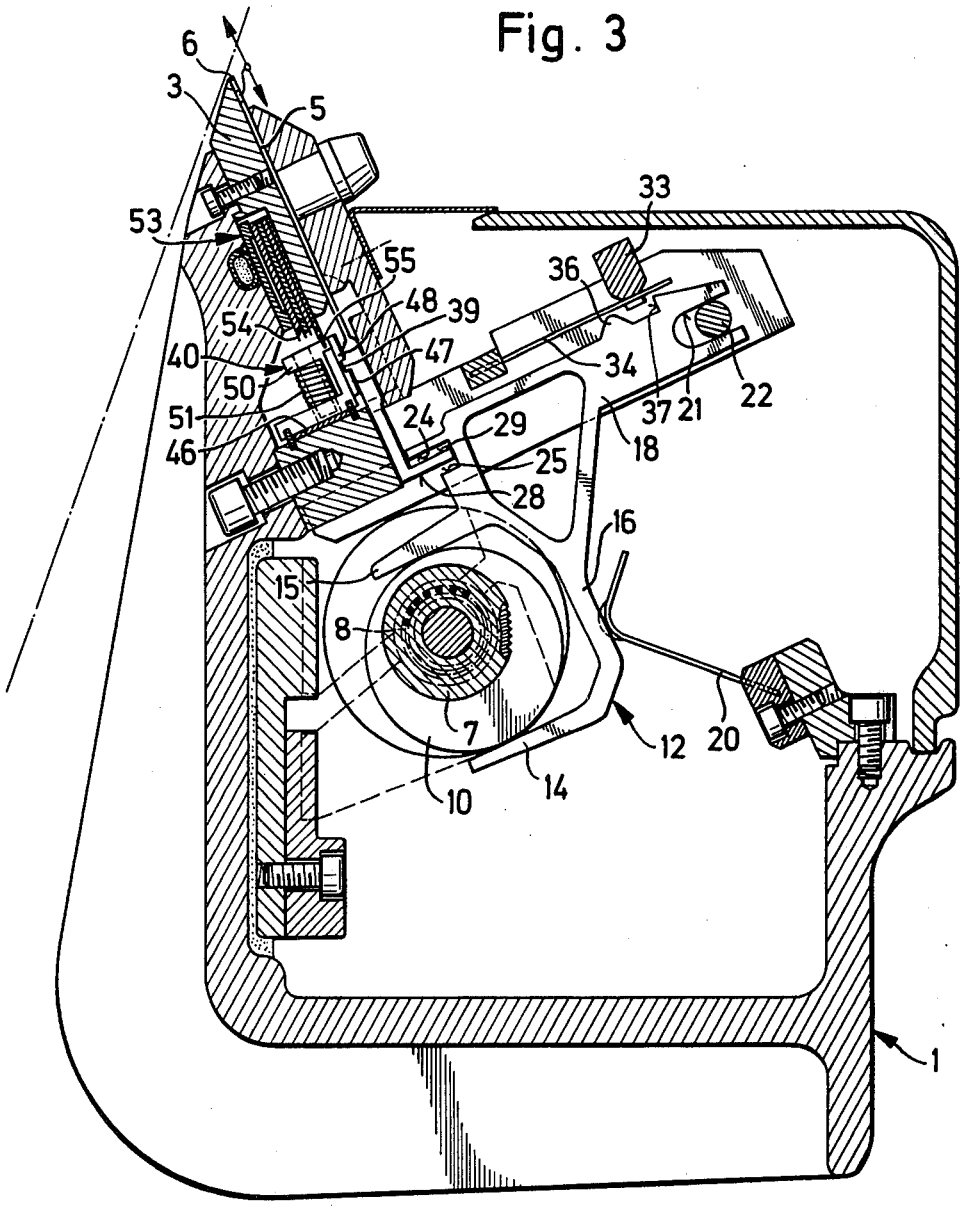
FIG. 3 is a section through a needle bed of the knitting machine according to FIG. 1.

The loop-forming machine according to the invention is illustrated in FIGS. 1 to 3 by the example of a flat knitting machine. Mounted fixedly in V form in a frame 1 are two needle beds 3 in the grooves of which knitting needles 5 with hooks 6, preferably latch needles, are mounted to be longitudinally slidable in known manner. In each needle bed 3, a driving shaft 7 is rotatably mounted in bearings 8. The driving shafts 7 can be rotated at the desired speed by means of drives (not shown). A number of eccentric cam discs 10 corresponding to the number of knitting needles 5 is arranged on the driving shafts 7, the cam discs being rotationally fast with these shafts, each cam disc 10 being arranged in the same plane as the associated knitting needle 5 and having a thickness which is smaller than the distance of the associated knitting needle 5 from the two adjacent needles. Alternatively, the cam discs 10 may be located in a different plane to that of the associated knitting needles 5 and the driving elements 12 may have a suitable bend or crank.

In accordance with FIGS. 2 and 3, on each cam disc 10 there is mounted a driving element 12 which is advantageously located in the same plane as the associated cam disc 10. Each driving element 12 is preferably in the form of a fork having two substantially parallel arms 14 and 15 which are connected by a connecting web 16 arranged substantially at right angles to them and operative as a coupling element. The two arms 14 and 15 embrace the cam disc 10 in the chosen example from two sides in such manner that their points of contact with the cam disc 10 are located on a line extending substantially parallel to the axes of the needles, so that on rotation of the driving shafts 7 the driving elements 12 are raised and lowered parallel to the axes of the needles by the cam discs 10 and in this way perform raising and drawing-down strokes. The cam discs 10 and the driving elements 12 are preferably so designed that, irrespective of the angular position, the two arms 14 and 15 always bear agains at least two opposite points on the cam disc 10, so that the driving element 12 is guided positively in each stage of its movement by the cam disc 10. For this purpose, the cam disc 10 does not need to be of circular form, but it is sufficient for it to constitute a lobed cylinder of which all the diameters are of equal length.

Figure 32:
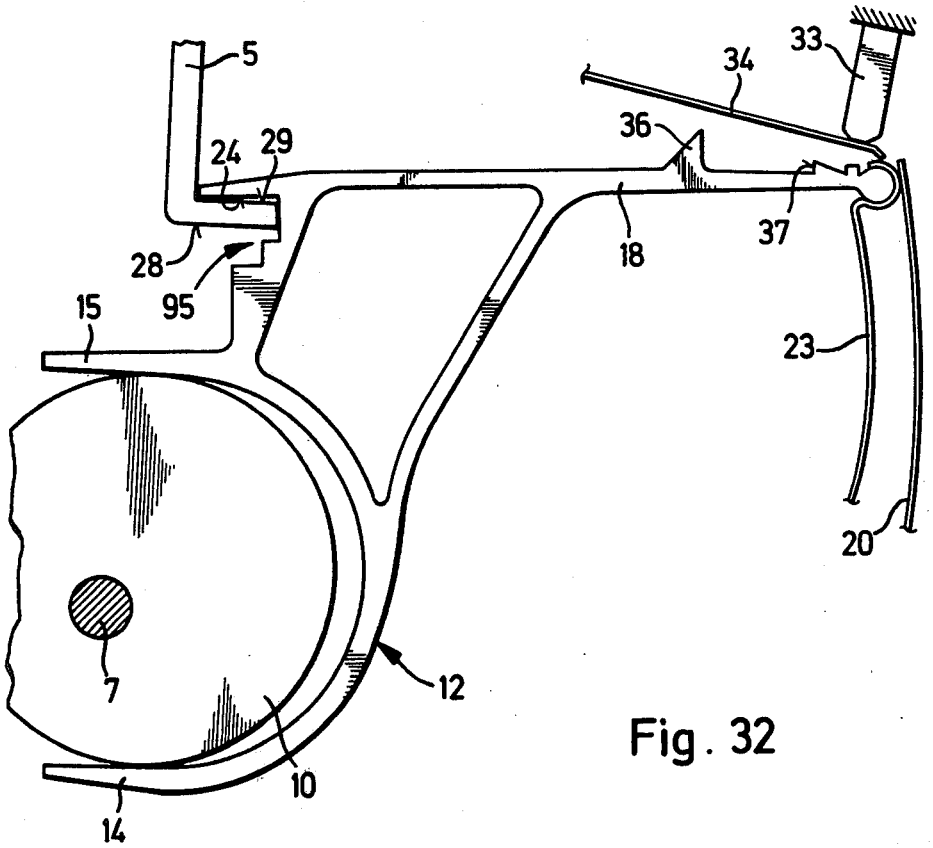
FIG. 32 shows a preferred constructional form of the mounting of the driving element of the driving and selection system according to FIGS. 9 to 16.

Provided on a lateral part of the driving element 12 facing the connecting web 16 is a shank 18 on the end of which, as shown in FIG. 2, there acts a pressure-applying spring 20 fixed to the machine frame 1, which tries to apply the connecting web 16 against the cam disc 10 and, according to FIG. 3, may bear alternatively against a different part of the driving element 12. The shank 18 is mounted in a sliding and pivot bearing which, for example, is formed by a slot 21 in the shank 18 and a pivot pin 22 fixed in the frame 1 and extending through the slot 21, so that on the one hand, by reason of the action of the pressure-applying spring 20, the driving element 12 is held against the cam disc 10 and, on the other hand, by reason of the sliding and pivot bearing 21, 22, is slidably and pivotally mounted. Alternatively, the driving element 12 may advantageously be mounted in a spring 23 (FIG. 32), so that it is able to carry out similar movements to those when it is mounted in the sliding and pivot bearing 21, 22. The spring 23 may at the same time take over the function of the pressure-applying spring 20.

In an upper section of the driving element 12 there is provided a recess the upper edge of which serves as a drawing-down portion 24 and the lower edge of which serves as a raising portion 25 for the butt of the knitting needle 5 associated with the recess, the lower edge of which butt is accordingly to be regarded as the raising means 28, while its upper edge is to be regarded as the drawing-down means 29. The drawing-down portion 24 has a length such that it overlaps the drawing-down means 29 during the drawing-down throw of the cam disc 10 in every possible position of the driving element 12, whereas the raising portion 25 is so short that it overlaps the raising means 28 only in the coupling position of the coupling element 16 which can be seen in FIGS. 2 and 3 and, on the other hand, is located outside the effective range of the raising means 28 in an uncoupling position which can be seen in FIG. 12.

For control of the knitting needles 5 according to pattern, a control device is provided for each of the needles and comprises, in the embodiment illustrated, a holding magnet 33 controllable according to pattern and a control spring 34, both of which are fixed in the frame 1. The control spring 34 is clamped at one end and its free end can be applied under initial tension against the polar surface of the holding magnet 33 by means of a projection 36 provided on the shank 18. If the holding magnet 33 attracts the control spring 34, then the connecting web 16 can be applied against the associated cam disc 10 by the pressure-applying spring 20 until the raising portion 25 overlaps the raising means 28. On the other hand, if the control spring 34 is not attracted by the holding magnet 33, then it drops from its polar surface by reason of its initial tension and applies itself against an abutment 37 formed on the shank 18, so that in spite of the action of the pressure-applying spring 20 the driving element is arrested in a retracted position and the raising portion 25 remains outside the range of engagement of the raising means 28.

The cam discs 10 arranged on the driving shafts 7 preferably have a constant angular staggering, so that in known manner a shape or course after the fashion of a thread is obtained and those cam discs which are arranged within a pitch form a knitting system. To produce the desired angular staggering, the cam discs 10 may be provided with a suitable inner serration, while the driving shafts 7 are provided with a corresponding outer serration. Alternatively, a spacing disc provided with an inner serration may be arranged between the cam discs in each case, while the cam discs 10 themselves do not have any inner serration, but are mounted almost free from play on the driving shafts 7, so that in the centered state they can be rotated into any position and then be fixed to the spacing discs or the like by cementing. For example, every twenty-four, thirty-six or seventy-two adjacent knitting needles 5 form a knitting system, i.e., every twenty-fourth, thirty-sixth or seventy-second cam disc 10 is mounted on the driving shafts 7 in the same angular position. In the embodiment which can be seen in FIG. 1, every ten adjacent knitting needles 5 form a knitting system and a total of five knitting system is provided on each needle bed 3. The phase relationship of the two driving shafts 7 may be varied for reasons of knitting technique. In the embodiment shown in FIGS. 1 and 2, each knitting needle 5 has a knitting butt 39 which can co-operate with a plurality of sinker elements 40. The sinker elements 40 are fixed to endless belts 42 which are mounted in each case on at least two guide pulleys 43 or other guide elements and are driven by means of a driving device (not shown). The direction of conveyance is indicated by arrows on the guide pulleys 43. In the region of the two rows of needles, the sinker elements 40 run parallel to the needle beds 3 onto stationary slide rails 46 extending over the entire width of the needle beds, so that they may always be arranged at the same unvarying height while they are travelling past the knitting needles 5. Each sinker element 40 has a first cam 48 operative in the drawing-down direction and a second cam 47 rising in the raising direction, which together form a trick 49 into which the knitting butts 39 of the knitting needles 5 run in order first to be drawing or drawn down by the first cam 48 for the purpose of forming a loop and then to be brought back into the normal run-through position by the second cam 47.

As can be seen in particular from FIG. 3, the second cam 47 is secured to a fixed part of the sinker element 40, whereas the first cam 48 is mounted slidably on the sinker element 40 and has an arm 50 on which a compression spring 51 mounted on the sinker element 40 acts. At least one slide rail 53 extending over the entire width of the needle beds 3 and adjustable in height serves as a counter-bearing for the upper edge of the cam 48. Preferably, a plurality of such adjustable slide rails 53 are provided, these having a guide 54 on their side facing the upper edge of the cam 48. In a number of grooves corresponding to the number of these guides 54, which are formed in the upper edge of the arm 50, plates 55 selected according to pattern can be inserted individually, the upper edges of these plates entering the guide 54 associated with them and thereby fixing the distance between the two cams 47 and 48. In this way, the sinking depth of the knitting needles 5 can be adjusted differently by the cams 48.

The sinker elements 40 are arranged at such a height relative to the knitting butts 39 that the latter can enter the trick 49 only after the knitting needles 5 have been drawn down almost as far as the normal run-through position by means of the drawing-down portions 24 of the driving elements 12. The cams 48 therefore become operative only at the end of a complete drawing-down throw of the cam discs 10 and produce only that small part of the drawing down which serves to form a loop or draw the loop of yarn formed by a hook 6 through the previously formed loop disposed on the needle shank, whereas the major part of the drawing down is carried out with the aid of the driving element 12 driven positively by the cam disc 10. In order to avoid the additional drawing-down stroke produced by the cam 48 disturbing the drawing-down stroke produced by the driving element 12, the arrangement is such that the distance between the drawing-down portions 24 and the raising portions 25 of the driving elements 12 is about as much greater than the distance between the raising means 28 and the drawing-down means 29 of the knitting needle 5 as corresponds to that additional drawing-down stroke which can be achieved at the most with the drawing-down or lowering cam 48, i.e., the driving connection of the knitting needle 5 with the cam disc 10 has so much play that the knitting needle 5 is movable in the direction of its movement by a sufficiently large distance in addition to the movement produced by the cam disc 10.

The distance between neighbouring sinker elements 40 on the belts 42 corresponds to the distance between the knitting systems expressed by the number of needles. The conveying speed of the belts 42 is so synchronized with the rotation of the driving shafts 7 that the first cams 48 always begin to act on a knitting butt 39 when the associated knitting needle 5 has been drawn down or lowered almost as far as the run-through position by the associated driving element 12.

The arrangement shown in FIG. 1 may, for example, be employed for supplying the yarn. Above the machine frame there is arranged a carrier 57 for yarn eyelets 59 which is disposed substantially in the middle of the needle beds 3 and at right angles to them and is so curved that all the yarn eyelets 59 are at substantially the same distance from the gap extending between the two needle beds 3. Above the yarn eyelets 59 there are provided in a creel (not shown) as many yarn bobbins 61 as there are yarn eyelets 59, it also being possible for reserve bobbins to be provided in known manner in case of need.

In the region of the hooks 6 of the knitting needles 5, referred to their raising position, a plurality of yarn guides 63 is provided. The yarn guides are fixed to endless belts 64 which are mounted in each case on at least two guide pulleys 67 or other guide elements and are carried past the knitting needles along a line parallel to the needle beds 3 by means of a driving device (not shown). Each yarn guide 63 has an eye 69 into which a thread 70 coming from some yarn bobbin 61 can be placed. During movement of the yard guides 63 in the direction of the arrows on the guide pulleys 67, a cutting device 71 known per se for the threads 70 is located at the ends of the needle beds 3 which are on the right in FIG. 1. This cutting device has the function of cutting off the thread 70 offered by any yard guide 63 as soon as it has been seized by the hook 6 of the last knitting needle 5 which works up this thread.

In order to carry the yarn end which becomes free through the cutting operation back to the end of the needle beds 3 which is on the left in FIG. 1, there is provided a blowing tube 72 through which compressed air is forced in the direction of the arrow P1 by means of a flexible tube 73 connected to a source of compressed air. The lower end of the blowing tube 72 is arranged in close proximity above that point at which the eyes 69 provided in the yarn guides 63 travel past and, for example, is mounted in a ball-and-socket joint 74 or the like. Associated with the blowing tube 72 is a swinging mechanism 75 which is basically of any kind can by means of which the upper end of the blowing tube 72 can be arranged close below each yarn eyelet 59. Each blowing tube 72 moreover has a lateral slot 76 extending through from top to bottom and directed towards the right-hand end of the needle beds 3 in FIG. 1 and which, in case of need, may be covered with an elastic material fixed along one edge of the slot, this elastic material, on the one hand, ensuring satisfactory conveyance of the thread in the blowing tube, yet on the other hand rendering possible lateral withdrawal of a thread in the blowing tube through the slot. Finally, the upper end of the blowing tube is so designed that, in conjunction with the compressed air supplied, it exerts a combined sucking and blowing action. The result of this is that a length of yarn hanging down through a yarn eyelet 59 and free at the end and therefore uncontrolled is, on the one hand, drawn to the upper end of the blowing tube 72 and, on the other hand, conveyed from there through the blowing tube 72 to its lower end, after adjustment of the upper end of the blowing tube 72 to the said yarn eyelet 59.

In order to clamp the free yarn end conveyed from the end of the needle beds 3 to the beginning of the needle beds 3 by means of the blowing tube 72, it is possible to provide at the left-hand end of the needle beds 3 in FIG. 1 either a conventional yarn clamping device (not shown) or a pneumatic suction device 68, by means of which the yarn end is retained with the aid of suction or intake air at least until the thread 70 has been inserted in a number of hooks 6 and has been worked up by them into a loop.

The yarn guides 63 are arranged on the belts 64 at intervals which correspond to the width of the knitting systems expressed by the number of needles. The conveying speed of the belts 64 is so synchronized with the speed of the driving shafts 7 that a thread 70 is offered to the open hooks 6 of the cleared knitting needles 5 shortly before these knitting needles 5 selected for knitting are drawn down by means of the driving elements 12 and then by means of the sinker elements 40.

If a three-colour pattern is to be produced on the five-system or five-feed knitting machine shown in FIG. 1, then six yarn bobbins 61, for example, are used for this purpose, each two yarn bobbins 61 being furnished with yarn of the same colour. The following operations therefore occur in constant repetition and may partly overlap. On the one hand, the thread carried past the hooks 6 of the selected knitting needles by any yarn guide 63 is cut off at the right-hand end of the needle beds 3, i.e., at the end of the knitted fabric, so that the thread hangs down freely from the associated yarn eyelet 59 and the associated yarn guide 63 can travel back at a rear part of a needle bed 3 to the left-hand part of the needle beds, i.e., to the beginning of the knitted fabric. On the other hand, after a thread conveyed in the blowing tube 72 to the beginning of the knitted fabric has been withdrawn through the lateral slot, the upper end of the blowing tube is adjusted to the to the eyelet 59 of that thread whose end is to be carried back, whereby this thread is sucked up in the direction of the eyelet 59, conveyed through the blowing tube 72 to the beginning of the knitted fabric, threaded into the eye 69 of the next yarn guide 63 travelling past below the lower end of the blowing tube 72 and finally retained at the beginning of the knitted fabric before this next yarn guide 63 comes into the insertion position for the first knitting needles 5. Since there are five systems or feeds, whereas there are six threads, a thread is always free in this way for being carried back.

A thread 70 which has been inserted in the eye 69 of a yarn guide 63 with the aid of the blowing tube 72 travels in the direction of the end of the knitted fabric together with this yarn guide. Since the thread end is first retained at the beginning of the knitted fabric, the thread is withdrawn through the slot of the blowing tube 72 by reason of the movement of the yarn guide, this withdrawal commencing in the lower part of the blowing tube 72 until, after the yarn guide has moved past a certain number of knitting needles 5, the entire length of thread between the yarn guide 63 and the yarn eyelet 59 has been drawn out of the blowing tube 72, so that its upper end can be adjusted to the eyelet 59 of the thread to be conveyed subsequently in good time before the arrival of the next yarn guide 63.

In dependence upon the number of knitting systems and the number of colours required, a plurality of blowing tubes may also be employed and their working cycles then partly overlap. Finally, by control of the blowing tube, it is possible to vary the sequence of the threads to be worked up in any desired manner. For winding down and batching or taking up the knitted fabric produced during the operation of the knitting machine, a winding-down and batching arrangement 75 is provided, this being accommodated below the gap in the frame 1 between the two needle beds 3.

The knitting machine described operates in the following manner:

To knit a single-colour knitted fabric without any pattern, the control springs 34 are constantly attracted by the holding magnets 33, so that they remain constantly swung out of the range of the abutment 37 of the shank 18. In consequence, if the movement of any knitting needle 5 is considered, the associated cam disc 10 first moves the driving element 12 mounted on it upwardly, the raising portion 25 of the driving element 12 engaging below the raising means 28 of the knitting needle 5 by reason of the action of the pressure-applying spring 20 and raising the knitting needle until the raising throw of the cam disc 10 has been completed and the knitting needle 5 has reached its highest position. At this moment, a yarn guide 63 travels past the opened hook 6 of this knitting needle 5, so that a thread 70 is inserted and is drawn into a loop by the hook 6 during the following drawing-down throw of the cam disc 10. During the first half of this drawing-down throw, the cam disc 10 presses simultaneously against the connecting web 16 which is operative as a coupling element, so that this connecting web is also shifted, together with the entire driving element 12, in a direction at right angles to the axis of the knitting needle 5 in opposition to the force of the pressure-applying spring 20. During this movement, the drawing-down portion 24 remains constantly in engagement with the drawing-down means 29 of the knitting needle 5. Since the control spring 34 is retained by the holding magnet 33, the driving element 12 is shifted back again during the second half of the drawing-down throw of the cam disc 10 in the direction at right angles to the axis of the knitting needle 5 by reason of the action of the pressure-applying spring 20, so that the raising portion 25 of the driving element 12 is again coupled with the raising means 28 of the knitting needle at the beginning of the next raising throw of the cam disc 10.

After completion of the drawing down throw, a sinker element 40 has reached such a position that its cam 48 begins to act on the knitting butt 39 of the knitting needle 5 located in the run-through position and imparts to the knitting needle 5 a sinking stroke the size of which has been adjusted beforehand to the desired value by means of the slide rails 53, while at the same time the cam disc 10 begins its raising throw, so that the knitting needle 5 is brought into its highest position again after completion of the sinking stroke. When the knitting needle 5 has reached this highest position again, the next yarn guide 63 is then in range of its hook 6, so that a thread can again be inserted.

If a pattern is to be produced by the knitting needle 5 considered remaining in the run-through position during a raising throw of the cam disc 10, then a control signal is so supplied to the holding magnet 33 that the control spring 34 drops off by reason of its initial tension and applies itself against the abutment 37 when the driving element 12 moves back in the direction at right angles to the axis of the needle. The connecting web 16 and also the driving element 12 are thereby arrested in a position in which the raising portion 25 is outside the effective range of the raising means 28 and consequently the knitting needle 5 is not raised during the raising throw of the cam disc 10. Since, however, the driving element 12 is raised with each raising throw, the projection 36 is applied against the control spring 34 and presses its end against the polar surface of the holding magnet 33 again, so that a fresh selection can be carried out.

Finally, if a multi-coloured pattern is to be produced, then on the one hand threads 70 of different colours are supplied to the yarn guides 63, while on the other hand the holding magnets 33 associated with the knitting needles 5 are suitably triggered, so that a Jacquard knitted fabric is produced in the usual manner. In this case, however, a course is not formed as each individual yarn guide 63 passes by the needle beds 3, but a number of yarn guides corresponding to the number of colours must be carried past the needle beds to form a course.

The production of stripe patterns is possible without triggering the holding magnets 33 in that only threads of a certain colour are blown into the eyes 69 of the yarn guides 63 by means of the blowing tube 72 over a certain number of courses and then a change is made according to pattern to the threads of a different colour.

Figure 4:
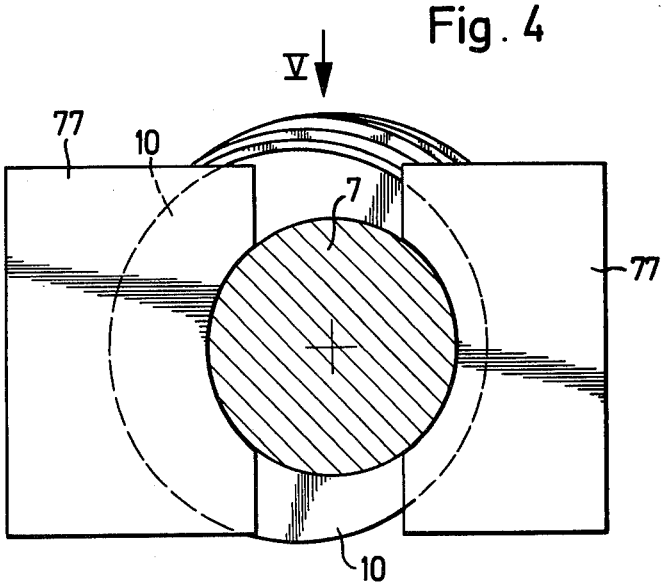
FIGS. 4 to 8 show diagrammatically four embodiments of a supplementary mounting for the driving shafts of the knitting machine according to FIG. 1.
Figure 5:
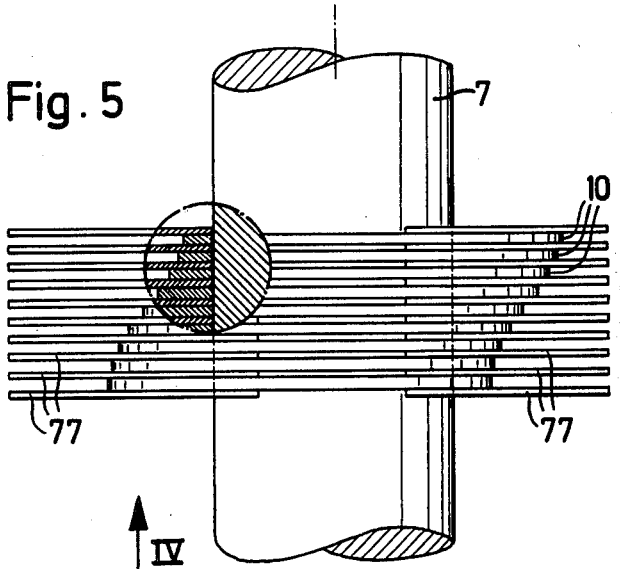

The driving shafts are preferably mounted not only at their ends, but also between their ends in some manner. According to the constructional form shown in FIGS. 4 and 5, each driving shaft 7 is mounted additionally at at least one point by means of at least two bearing plates which are mounted fixedly in the machine frame. These bearing plates are preferably formed as spacing plates 77 at the same time and each arranged between two cam discs 10, so that they have a dual function. The spacing plates 77 embrace the driving shafts 7 with their bearing surfaces over a major part of the periphery of the shafts, the radius of the bearing surfaces being equal to the radius of the driving shafts, and establish a direct outer mounting for the driving shafts 7.

Figure 6:
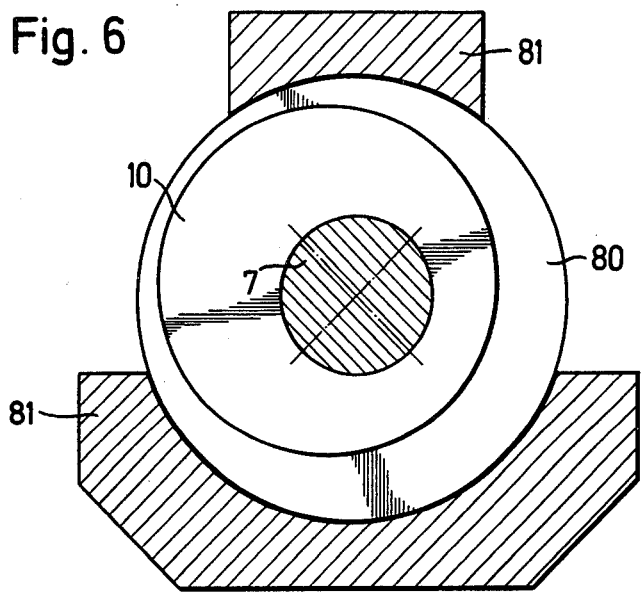

An embodiment of an indirect supplementary outer mounting is shown in FIG. 6. In this embodiment, a circular spacing plate 80 is fitted on the driving shafts 7 between each two cam discs 10, it being possible for the spacing plate 80 to have an inner serration or toothing and for the driving shafts to have an outer serration or toothing. At least one spacing plate 80, but preferably a plurality of all of the spacing plates 80 is or are engaged from at least two sides by the bearing surfaces of bearing plates 81 mounted fixedly in the machine frame, the bearing plates embracing the spacing plates 80 over a fairly large part of their circumference. The radius of the spacing plates 80 is preferably greater than the maximum radius of the cam discs 10, so that their lateral surfaces act at the same time as guide surfaces for the driving elements 12 and therefore have a threefold function, while the bearing plates 81 may be replaced in each case by a plain bearing extending over the width of the needle beds 3. In comparison with the embodiment according to FIGS. 4 and 5, the bearing surfaces are substantially larger by reason of the indirect mounting engaging the spacing plates 80. In both embodiments, the bearing and guide surfaces run in oil.

Figure 7:
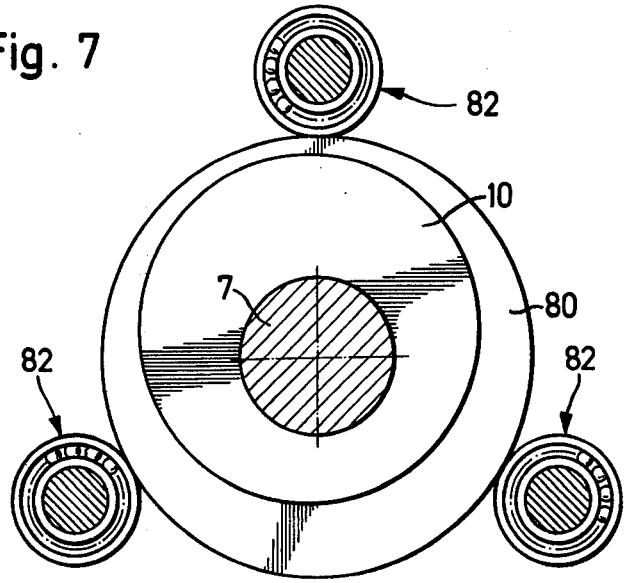

A second constructional form of the indirect outer mounting is shown in FIG. 7. In contrast to the embodiment according to FIG. 6, the spacing plates 80 are not guided in plain or sliding bearings, but in rolling bearings 82 which are arranged at at least three points at the periphery of the spacing plates 80 and may extend over the width of the needle beds.

Figure 8:
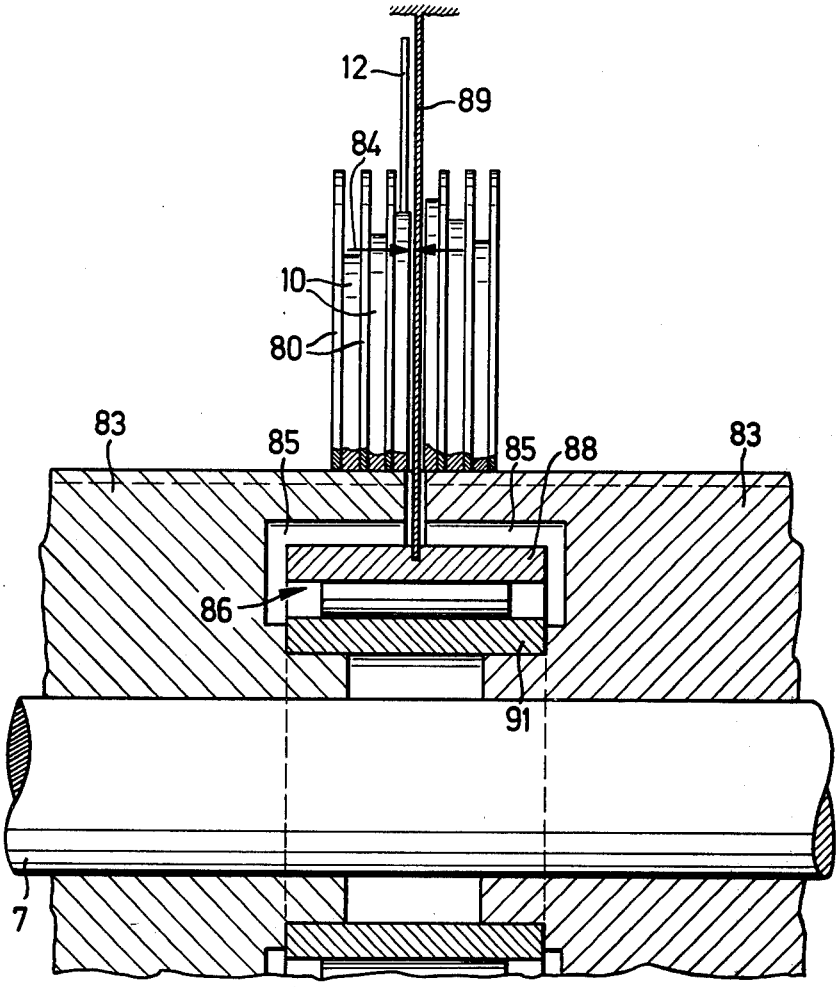

According to a preferred constructional form shown in FIG. 8, the cam discs 10 are not mounted directly on the driving shafts 7 themselves, but on a plurality of sleeves 83 which are fitted on the driving shafts 7 so as to be rotationally fast therewith but axially slidable thereon and are spaced apart by gaps. A group of cam discs 10 and spacing plates 80 is mounted on each sleeve 83 and is rotationally fast therewith and axially unslidable thereon. The advantage of this constructional form consists in that in comparison with the temperature of the needle beds 3 the temperature of the driving shafts 7 can be subjected to relatively great variations without the relative shifts between the driving shafts and the needle beds involved thereby being able to have a detrimental effect on the relative positions of the knitting needles 5, the cam discs 10, the driving elements 12 and the connecting webs 16 with respect to one another. If, when the sleeves 83 are fitted, they are placed exactly opposite the associated group of needles, which can be achieved by supplementary lateral guiding of the associated driving elements 12, it is ensured that the expansion of the sleeves 83 produced by variations in temperature remains below the tolerance limit and is taken up by small gaps 84 in the region of the junction point. Since these gaps 84 are very small in comparison with the thickness of a cam disc 10 or a spacing plate 80, they cannot interfere with the operation thereof.

In order also to create a supplementary mounting of the driving shafts 7 in the constructional form according to FIG. 8, an indirect internal mounting is provided. The sleeves 83 have at their junction points or areas, symmetrical recesses 85 which afford sufficient room for a rolling bearing 86, the outer race 88 of which is fixed to at least two anchoring stays 89, each anchoring stay being arranged in the region of the junction point or area in place of a spacing plate 80 and extending through the gap between the adjoining ends of the sleeves 83 into the space formed by the recesses 85. The inner race 91 of the rolling bearing 86 is fixed to the two adjoining sleeves 83, so that on rotation of the driving shaft 7 and the sleeves 83 it rolls on the stationary outer race 88. This constructional form renders possible not only a supplementary mounting for the driving shafts 7, but also a compensation of the changes in the length of the driving shafts 7 caused by variations in temperature. In place of the rolling bearing 86, which also centres the ends of the sleeves 83, a plain or sliding bearing may be provided.

Starting from the constructional form according to FIGS. 2 and 3, the selection of the knitting needles 5 may be effected in various ways. In all the constructional forms, however, at least four basic elements are provided for selection, namely the cam disc 10, the driving element 12 with at least one raising portion 25 and one drawing-down portion 24, the coupling element (for example, the connecting web 16) and the knitting tool 5 with a raising means 28 and a drawing-down means 29.

The cam disc 10 serves to produce raising and drawing-down throws. A raising throw constitutes that part of a revolution of the cam disc 10 which serves to shift or raise the knitting needles 5 out of a normal lower inoperative position into an upper position (knitting or tucking height) needed for forming a loop, while a drawing-down throw corresponds to that part of a revolution of the cam disc 10 which is needed for lowering a partially (tucking height) or completely (knitting height) shifted knitting needle 5 into the inoperative position again. Both the raising and the drawing-down throws may comprise a half revolution or less than a half revolution of the cam disc 10.

Although throw movements in each direction can be derived from the rotary movement of the cam disc 10, for shifting a knitting needle 5 only those components of the throw movements are needed as a rule which lie in one direction (hereinafter called the throw direction or the direction of the raising and drawing-down throws, which extends parallel to the axis of the knitting needles 5 in the constructional form according to FIGS. 2 and 3, but could also extend along the axis of the knitting needles 5 or along any other axis, if care is taken that the components located on this axis are so deflected by suitable intermediate members such as jacks, sinkers, levers or the like that they are suitable for indirectly shifting the knitting needles 5.

According to the invention, the driving element 12 is an element which is constantly driven positively by the cam disc 10 in the throw direction. As can be gathered from FIGS. 2 and 3, this means that the driving elements 12 need to be constantly coupled positively with the cam discs only in the directions parallel to the axes of the knitting needles 5, whereas in all the directions deviating from these directions they may be shifted relative to the cam discs 10. Depending upon the kind of design of the selection system chosen in the individual case, the driving elements 12 may also alternatively rest positively on the cam discs in all directions.

The coupling element serves to couple the raising portions 25 of the driving elements 12 according to pattern with the raising means 28 of the knitting needles 5 or other knitting tools (supplementary elements) in such manner that the movement of the driving elements 12 taking place in the direction of the raising throws is transmitted to the knitting needles 5 as long as is necessary for reasons of knitting. Moreover, the coupling elements can adopt a plurality of positions, namely an uncoupling position, in which the driving elements 12 are not coupled with the knitting needles 5 during the raising throws, and at least one coupling position, in which there is a driving connection between the driving elements 12 and the knitting needles 5 during the raising throws.

According to the invention, the driving elements 12 have a special significance during the drawing-down throws, since they are intended to produce a drawing-down of the knitting tools 5 irrespective of the position in which the coupling elements 16 are disposed. The result achieved by this measure is that during a drawing-down throw the coupling elements can be brought into that position which is desired during the following raising throw. In the constructional form of the control device according to FIGS. 2 and 3 (holding magnet 33 and control spring 34), basically all the coupling elements, irrespective of the position they are in, are first brought into the uncoupling position and thereafter according to pattern into the coupling position during the drawing-down throws. Alternatively, if other control devices are employed, it is possible during the drawing-down throw first to bring all the coupling elements into the coupling position and then to bring selected coupling elements into the uncoupling position.

Figure 9:
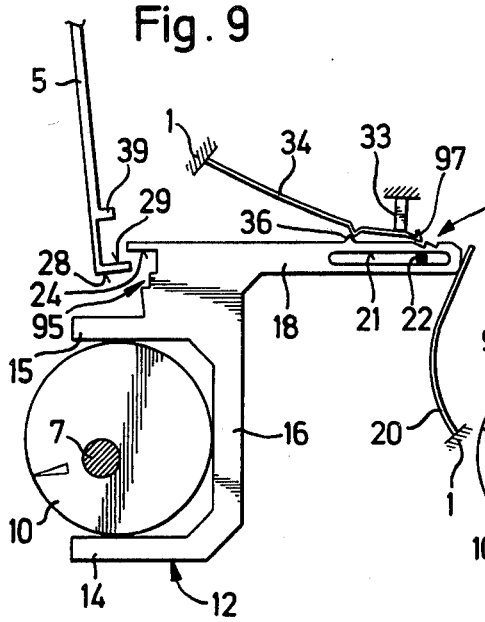
FIGS. 9 to 16 show diagrammatically a constructional form of the driving and selection system for a knitting needle in various stages of movement.

The constructional form according to FIGS. 9 to 16 differs from the constructional form according to FIG. 2 essentially in that in addition to a choice between knit and miss a choice between knit and tuck is also possible. The very diagrammatic representation according to FIG. 9 shows that it is merely necessary to form the raising portion of the driving element 12 as a step 95 and the abutment in the shank 18 as a step 96. The step 96 is preferably located in the vicinity of the pivot of the driving element 12, because the movement of the driving element taking place in the throw direction makes itself least noticeable at this point. The mode of operation of the constructional form according to FIGS. 9 to 16 is as follows:

In FIG. 9, the cam disc 10 is in the first half of its drawing-down throw, so that the knitting needle 5 is drawn down according to whether it was previously completely raised or raised into the tucking position, because its camming-down means 29 is constantly overlapped by the drawing-down portion 24, while at the same time the projection 36 presses against the control spring 34 and applies it against the polar surface of the holding magnet, because the cam disc 10 also bears against the coupling element in the form of the connecting web 16 and shifts it together with the driving element 12 more and more to the right in a direction at right angles to the throw direction. After the control spring 34 has been applied against the holding magnet 33, a control signal can be supplied to the latter.

Figure 10:
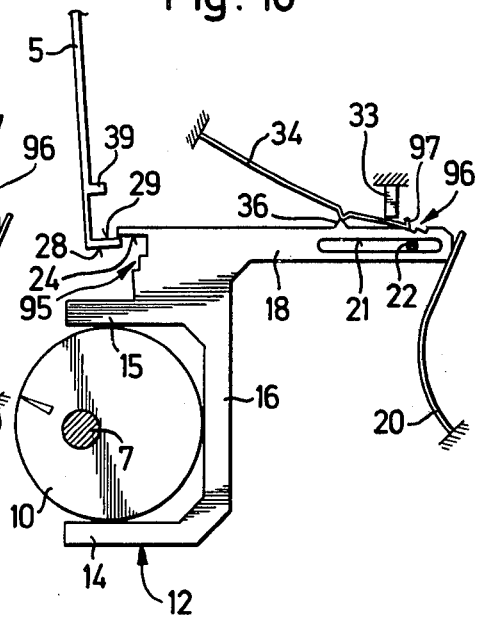
Figure 11:
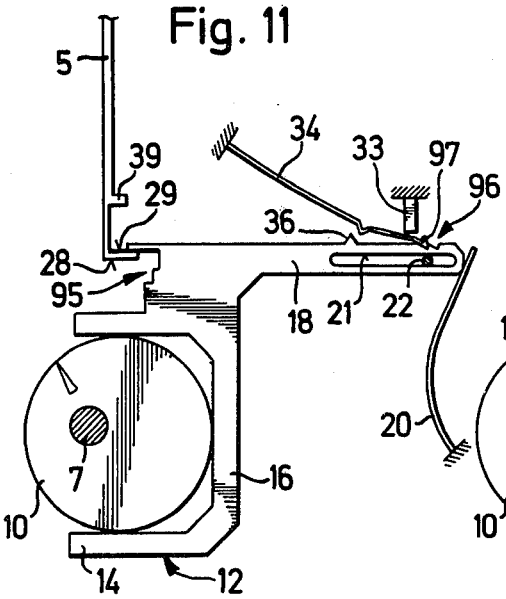
Figure 12:
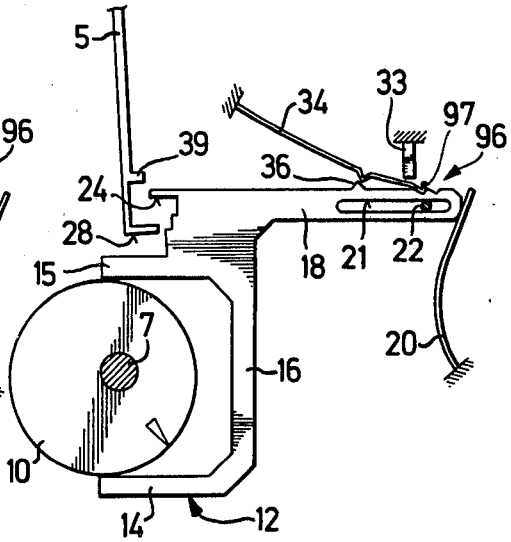
Figure 13:
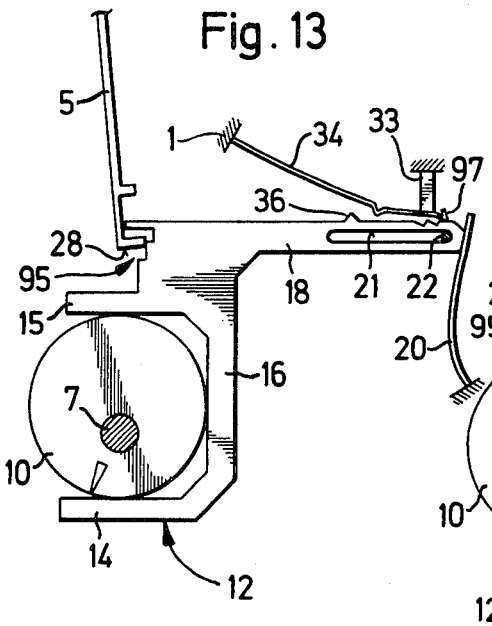

It is apparent from FIG. 10 that the control spring 34 has already dropped off the holding magnet 33 before the cam disc 10 has completed the first half of the camming-down throw and the connecting web 16 has reached the uncoupling position which is located furthest to the right. The result of this is (FIG. 11) that a beak 97 located on the control spring engages behind the first part of the step 96 in the shank 18 as soon as the cam disc 10 is in the second half of the drawing-down throw and the pressure-applying spring 20 tries to hold the connecting web 16 against the cam disc 10, so that the connecting web 16 is therefore arrested in its uncoupling position and the raising portion of the driving element 12 in the form of a step 95 is held outside the effective range of the raising means 28 of the knitting needle 5. During the following raising throw of the cam disc, the knitting needle 5 is therefore not affected (FIG. 12). After the commencement of another drawing-down throw the cam disc 10 applies itself against the connecting web 16 again in the manner shown in FIG. 9, so that the beak 97 moves out of the step 96, the control spring 34 is applied against the holding magnet 33 and a fresh selection can be made.

If the control spring 34 also remains attached to the holding magnet during the second half of the drawing-down throw, then the pressure-applying spring 20 causes the connecting web 16 to remain constantly biased towards the cam disc 10 (FIG. 13), so that the first part of the step 95 of the driving element 12 is coupled for driving with the raising means 28 of the knitting needle 5. The connecting web 16 is located in one coupling position.

Figure 14:
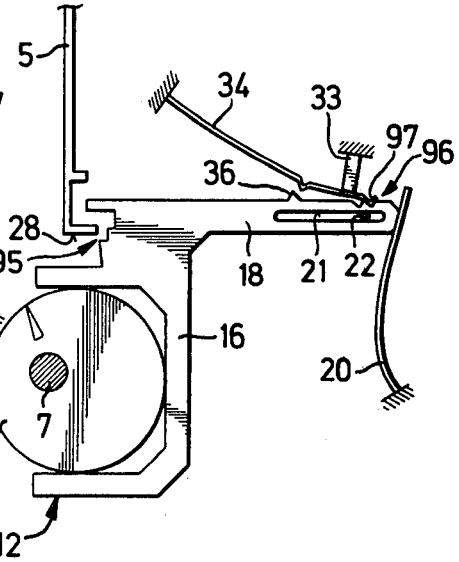
Figure 15:
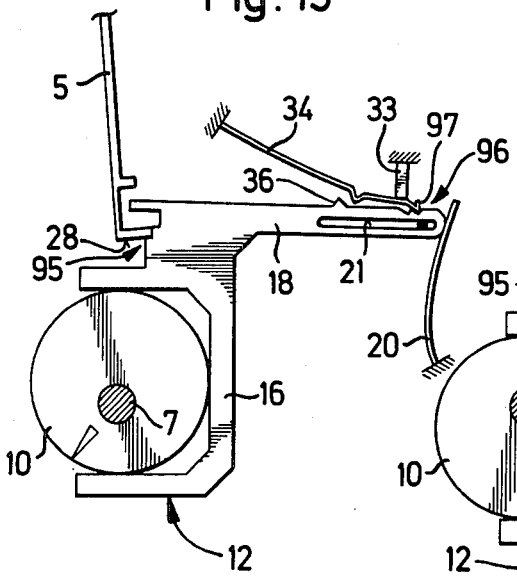

If it is desired that a tuck loop be formed, then a control signal is supplied to the holding magnet 33 during the second half of the drawing-down throw when the beak 97 of the control spring 34 is over the second part of the step 96 in the shank 18 and therefore drops into this part (FIG. 14). Exact synchronization of this operation with the movement of the cam disc is easily possible because the time which is required for shifting the shank 18 by a distance which is equal to the distance between the two parts of the step 96 corresponds to a certain angle of rotation of the cam disc 10. The result of this control action is that the connecting web 16 is arrested in its other coupling position and the second lower part of the step 95 of the driving element 12 remains arranged exactly below the raising means 28 of the knitting needle 5. During the following raising throw, the knitting needle is raised into the tucking position (FIG. 15).

Figure 16:
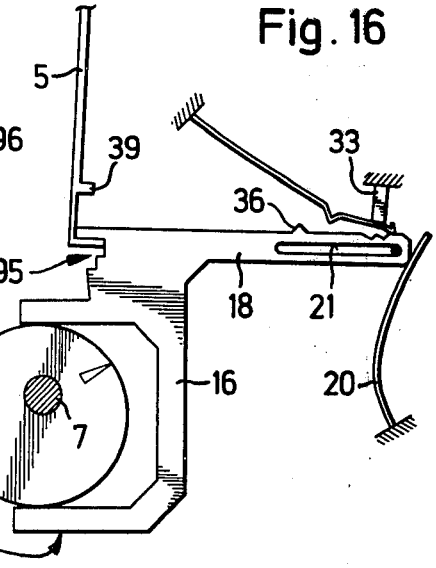

Finally, it can be seen from FIG. 16 that after each knitting needle 5 has been brought with the aid of the driving element 12 into that position which corresponds to the normal inoperative position, it can be drawn down into a still lower position with the aid of other means, for example the sinker elements 40 acting on the knitting butts 39, because the distance between the raising and drawing-down means 28 and 29 of the knitting needles 5 is smaller than the distance between the raising and drawing-down portions 25 and 24 of the driving elements 12, the raising portion being formed in this case by the first (upper) part of the step 95.

Figure 17:
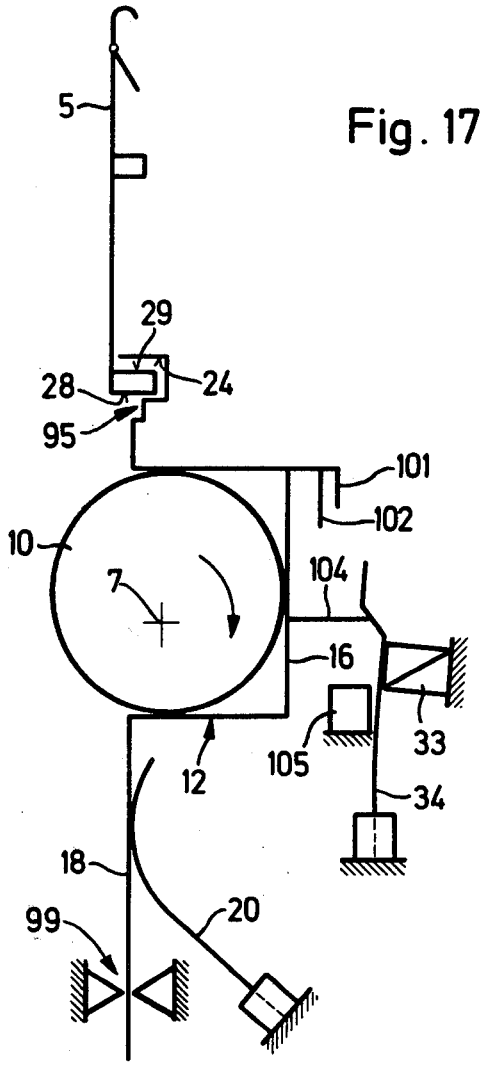
FIGS. 17 to 20 show another four embodiments of the driving and selection system.

A forked driving element 12 having a connecting web 16 acting as a coupling element and an elongated shank 18 is also provided in the constructional form shown in FIG. 17. In contrast to the embodiment according to FIGS. 9 to 16, however, the knitting needles 5, the shank 18 and a sliding and pivot bearing 99 formed of conical bearing heads are located substantially on the same axis. Provided on a lateral part of the driving element 12 are two downwardly extending arms 101 and 102 which co-operate with the control spring 34 of the holding magnet 33, while a projection 104 arranged on the connecting web 16 can also act on the control spring 34. The direction of rotation of the cam disc 10 is indicated by an arrow. The mode of operation of this constructional form is as follows:

After the cam disc 10 has completed its raising throw, it applies itself against the connecting web 16 and pushes it and, consequently, also the projection 104 to the right in FIG. 17, whereby the control spring 34 is applied against the holding magnet 33. If the control spring 34 is retained thereat, its upper end can apply itself against the arm 101 only from the outside during the drawing-down throw, the result of which is that the connecting web 16 also bears against the cam disc 10 after completion of the drawing-down throw, which corresponds to that coupling position of the connecting web 16 which results in a raising of the knitting needle 5 into the highest position. If, on the other hand, the control spring 34 is not held by the holding magnet, it applies itself against a stop 105 before its upper end comes into the effective range of the lower end of the arm 102, with the result that its upper end is applied against the arm 102 from the left side in FIG. 17 in the further course of the drawing-down throw. In this way, the connecting web 16 is arrested in its uncoupling position, so that it cannot follow the cam disc 10 in the second half of the drawing-down throw and neither of the two parts of the step 95 is arranged in the effective range of the raising means 28 of the knitting needle 5. During the following raising throw, the knitting needle 5 is therefore not affected and the next selection is initiated in that the projection 104 applies the control spring 34 against the holding magnet 33 again after the lower end of the arm 102 has slid off the upper end of the control spring 34. Finally, for forming tuck loops, the control spring 34 is then released according to pattern by suitable control of the holding magnet 33 when its upper end, in FIG. 17, is between the lower end of the arm 102 and the lower end of the arm 101. The effect of this is that during the further course of the drawing-down throw the upper end of the control spring 34 enters the passage between the two arms 101 and 102 and the connecting web 16 is arrested in a middle position, i.e., in its second coupling position, in which that part of the step 95 which is on the left in FIG. 17 is arranged below the raising means 28 of the knitting needle 5. In the following raising throw, the knitting needle 5 therefore reaches only the tucking height.

While the constructional forms described so far with reference to FIGS. 9 to 17 have the characteristic that the driving element 12 is rigidly connected to the coupling element (the connecting web 16) and the coupling element, together with the driving element, can be both shifted in the throw direction and also swung in a direction at right angles thereto, embodiments are hereinafter described in which the coupling element is either articulated or not connected at all to the driving element 12 and in which the driving element can only be shifted in the throw direction.

Figure 18:
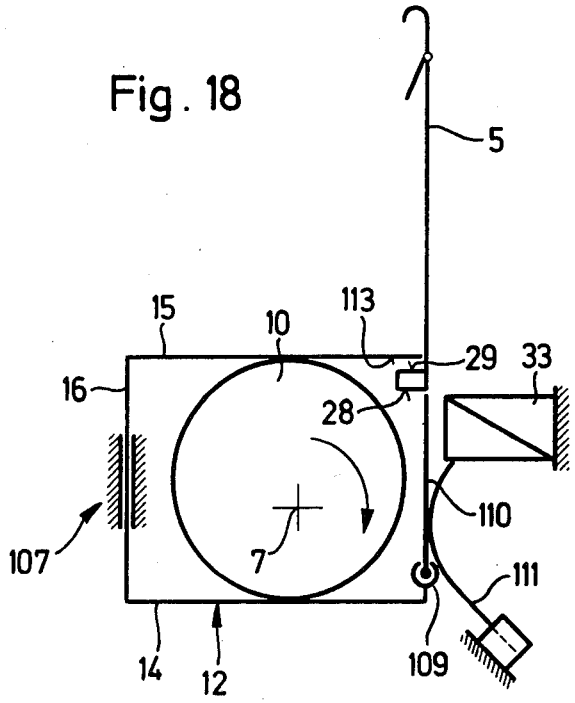

According to FIG. 18, the driving element 12 consists as before of a fork with two arms 14 and 15 which touch the cam disc 10 at at least two opposite points in every angular position and are connected by a rigidly fixed connecting web 16. In this case, of course, this connecting web 16 does not serve as a coupling element, but for mounting the driving element 12 in a sliding bearing 107 arranged parallel to the throw direction. Mounted on an extension of the free end of the arm 14 is a pivot or swivel bearing 109 in which a rod 110 acting as a coupling element and on which a pressure-applying spring 111 acts is mounted so that is can pivot, but is axially immovable. The holding magnet 33 is arranged on that side of the rod 110 which faces away from the cam disc 10, while the raising means 28 of the knitting needle 5 is arranged immediately above the rod 110, so that the free end of the rod acts as the raising portion of the driving element 12. The drawing-down means 29 of the knitting needle 5 is constantly arranged below a drawing-down portion 113 of the driving element 12 which is formed as an extension of the arm 15, since neither the knitting needle 5 nor the driving element 12 can be swung in the direction at right angles to the axis of the needle. The direction of rotation of the cam disc 10 is indicated by an arrow. The embodiment according to FIG. 18 operates in the following manner:

After the cam disc 10 has completed its raising throw, the raising means 28 of the knitting needle 5 is lifted away from the free end of the rod 110 by reason of a slight play between the drawing-down portion 113 and the camming-down means 29. After about one half of the drawing-down throw, the cam disc 10 is applied against the rod 110 and pushes it in the plane of the driving element against the polar surface of the holding magnet 33, and thereby into the uncoupling position, in opposition to the force of the pressure-applying spring 111. If the holding magnet 33 attracts the rod 110 during the second half of the drawing-down throw, its upper end is then arranged outside the effective range of the raising means 28 of the knitting needle 5, so that the needle is not affected during the following raising throw. If, on the other hand, the rod 110 is released by the holding magnet 33 during the second part of the drawing-down throw, it is applied against the cam disc 10 by the pressure-applying spring 111 and thereby changed over into the coupling position, so that its upper end is applied below the raising means 28 and the knitting needle 5 is raised. Consequently, the coupling element in the form of the rod 110 also serves in this constructional form to couple the knitting needle 5 with the driving element 12 for driving purposes, in that it transmits or does not transmit the raising force derived from the pivot bearing 109 to the raising means 28, according to pattern.

Alternatively, a choice between knit and tuck may also be provided in the constructional form according to FIG. 18, in that either the raising means 28 of the knitting needle 5 or the upper end of the rod 110 is formed as a step and the holding magnet 33 is moreover suitably triggered. In addition, it is possible to make the distance between the upper end of the rod 110 and the drawing-down portion 113 so much larger than the distance between the raising means 28 and the drawing-down means 29 that, as in the embodiments according to FIGS. 9 to 17, an additional sinking throw not derived from the cam disc 10 can be exerted on the knitting needle 5.

Figure 19:
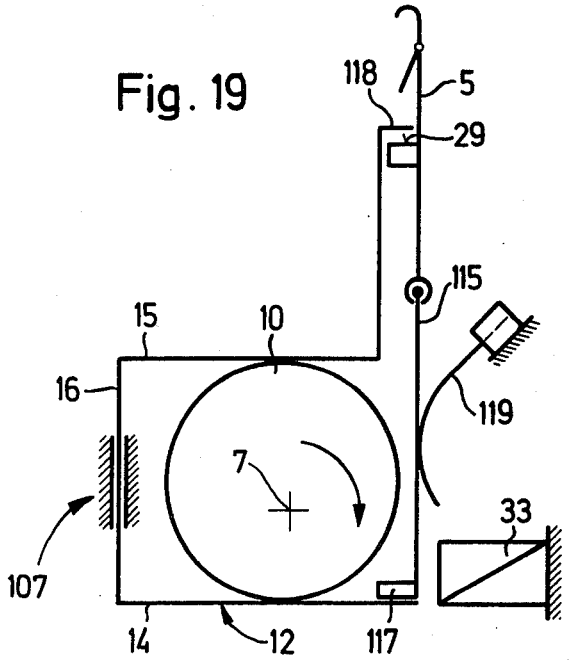

In the constructional form illustrated in FIG. 19, the driving element 12 consisting of two arms 14 and 15 and a connecting web 16 is mounted in a sliding bearing 107 parallel to the axis of the needle, as in the constructional form according to FIG. 18. On the other hand, there is provided as the coupling element a rod 115 pivotally attached to the knitting needle 5 and which is arranged between the two arms 14 and 15 on the extension of the axis of the needle and has a butt 117 the lower edge of which co-operates as the raising means with the upper edge of the extension of the arm 14, the said upper edge being operative as the raising portion. The upper edge of a butt of the knitting needle again serves as the drawing-down means 29 for the knitting needle 5, while the drawing-down portion of the driving element is formed by a suitably bent extension 118 on the driving element 12. The mode of operation of the constructional form according to FIG. 19 is as follows:

After the cam disc 10 has completed its raising throw, the butt 117 lifts away from the extension of the arm 14 by reason of a small play between the drawing-down means 29 and the extension 118, so that in the further course of the drawing-down throw the rod 115 is swung against the polar surface of the holding magnet, and consequently into the uncoupling position, by the cam disc 10 in opposition to the force of a pressure-applying spring 119, the swinging action taking place in the plane of the cam disc. Depending upon whether the holding magnet 33 attracts the rod 115 or releases it before completion of the drawing-down throw, the lower edge of the butt 117 is located or not located in the effective range of the upper edge of the extension of the arm 14 at the beginning of the raising throw, so that knitting is carried out or not according to pattern. In this constructional form, as in the constructional form according to FIG. 18, the release or selection of the rod 115 can take place long before completion of the drawing-down throw. The butts 117 of the rods of those knitting needles 5 which are not selected for knitting also cannot in fact get below the extension of the arm 14, because they are held by the cam disc 10 in a position deviating from the coupling position until the drawing-down throw is almost completed. In the coupling position, the coupling element in the form of the rod 115 produces driving coupling of the knitting needle 5 with the driving element 12.

Alternatively, it is also possible in this constructional form to provide a choice between knit and tuck by suitable design of the butt 117 or of the upper edge of the extension of the arm 14. The production of an additional sinking throw is likewise possible.

Figure 20:
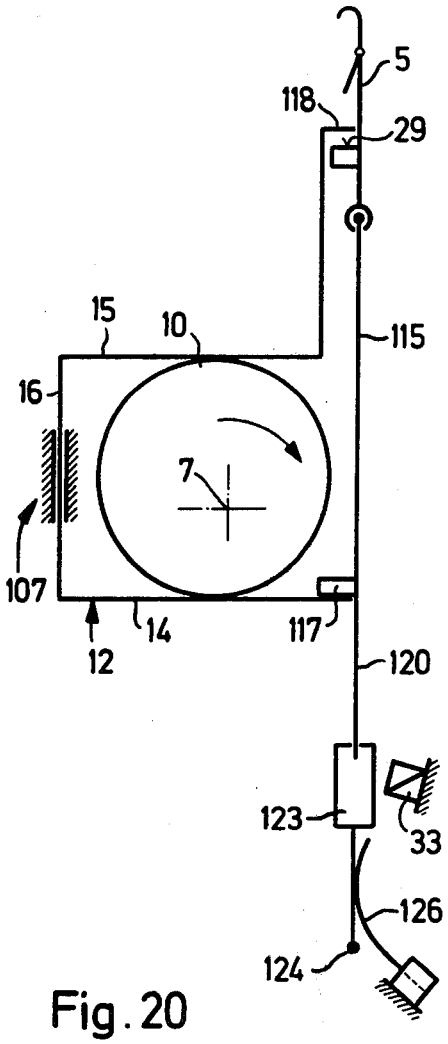

According to FIG. 20, in order to avoid the rods 115 having to slide along the polar surfaces of the holding magnets 33 in the direction of the axes of the needles during the drawing-down and raising throws, the rods 115 are provided with an extension 120. This extension 120 is mounted in a guide fork 123 and can be shifted therein in the direction of the axis of the needle, while the guide fork 123 is arranged in the plane of the driving element 12 and can be swung in this plane about a pivot point 124. A pressure-applying spring 126 biases the rod 115 towards the cam disc 10 via the guide fork 123, and conversely, owing to the fact that the cam disc acts on the rod 115, the guide fork 123 can be swung and applied against the polar surface of the holding magnet 33 and thereafter be released or retained by the latter according to pattern. Consequently, the difference from the constructional form according to FIG. 19 consists in that not the rod 115 moved in the throw direction by the driving element 12, but the pivotally mounted guide fork 123 not movable in the direction of the axis of the needle is influenced according to pattern.

Figure 21:
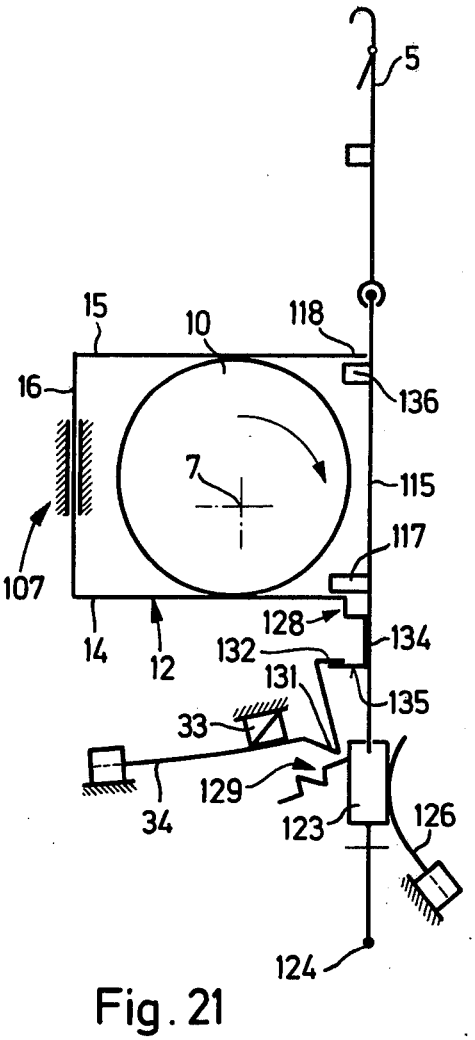
FIGS. 21 to 25 show another embodiment of the driving and selection system in various stages of movement.

The constructional form according to FIG. 20 can also be extended as shown in FIG. 21 by a possibility of choice between knit and tuck. To this end, on the one hand, the upper edge of the extension of the arm 14 is in the form of a step 128 having two parts, while on the other hand there is arranged on the guide fork 123 a step 129 having two parts and which, similarly to the embodiments according to FIGS. 9 to 17, co-operates with a control spring 34 controlled by the holding magnet 33 which has a beak or nose 131. Formed on an extension of the beak 131 is a shoulder 132 which co-operates with an arm 135 arranged on a vertical extension 134 of the step 128 and which engages below the shoulder 132 in every position of the driving element 12 and applies the control spring against the holding magnet 33 shortly before completion of the raising throw. Finally, as a further modification of FIG. 20, the rod 115 has a butt 136, the upper edge of which acts as a drawing-down means which co-operates with the drawing-down portion 118 of the driving element. Both the raising portions and the drawing-down portions of the driving elements can therefore act on raising and drawing-down means, respectively, which are not located on the knitting needle 5, but on other knitting tools or even on the coupling element. The mode of operation of the constructional form according to FIG. 21 is as follows:

After the cam disc 10 has completed its raising throw, the cam disc 10 applies itself against the rod 115 and pushes it outwards until it has been swung out of the effective range of the step 128 into the uncoupling position, so that the beak 131 of the control spring 34 is disposed behind the left-hand part of the step 129 in FIG. 21 by reason of a corresponding swinging movement of the guide fork 123. If, at this time, the control spring 34 is released by the holding magnet 33, having been applied against the polar surface of the holding magnet shortly before completion of the raising throw by reason of the co-operation of the arm 135 with the shoulder 132, then the control spring drops off by reason of its initial tension and its beak 131 is applied against the first part of the step 129 as soon as the guide fork 123 is swung a little to the left by the pressure-applying spring 126 during the second part of the drawing-down throw. In this way, the coupling element in the form of the rod 115 is arrested in its uncoupling position, so that the knitting needle 5 is not raised during the following raising throw.

If the knitting needle 5 is to knit, the control spring 34 is retained by the holding magnet 33, so that during the second half of the drawing-down throw the rod 115 is swung back in the direction of the cam disc 10 until the lower edge of its butt 117 is located over the higher part of the step 128, i.e., until one coupling position which results in a raising of the knitting needle 5 into the knitting position has been reached.

Finally, for controlling the knitting needle 5 into the tucking position, the control spring 34 is released by the holding magnet 33 during the second half of the drawing-down throw only when the beak 131 is arranged in the region of the second part of the step 129, so that after release it abuts against this part and thereby arrests the rod 115 in the second coupling position, in which the lower edge of the butt 117 is located over the lower part of the step 128, so that the knitting needle 5 only reaches the tucking position during the raising throw.

Figure 22:
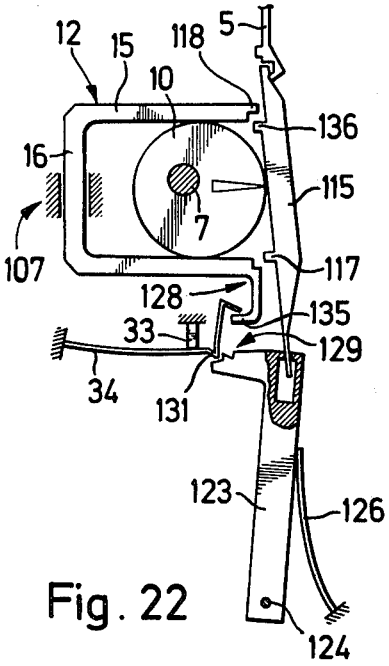
Figure 23:
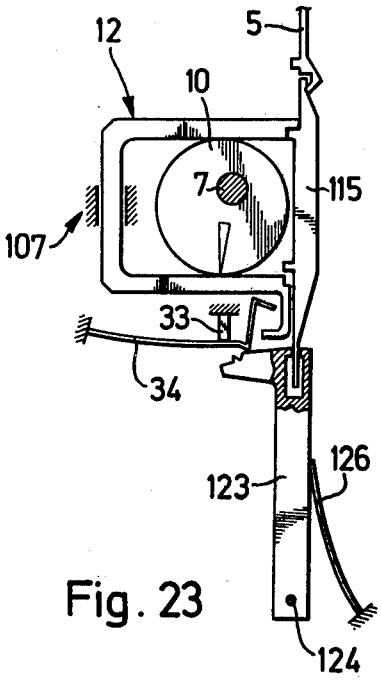
Figure 24:
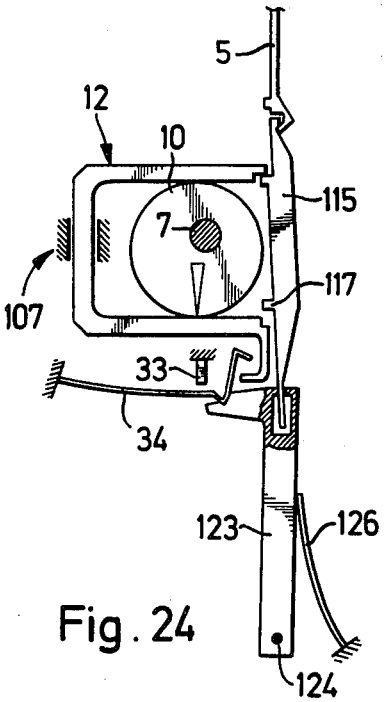
Figure 25:
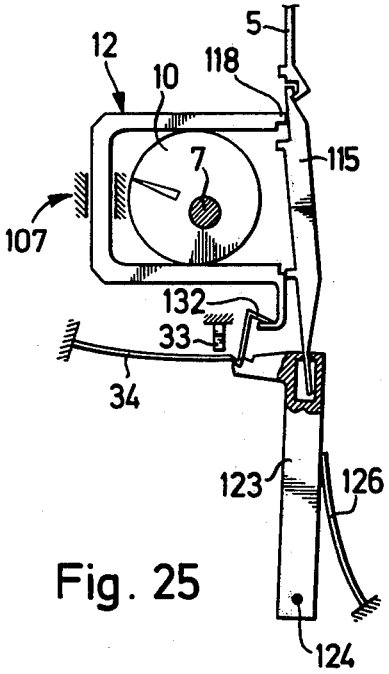

FIGS. 22 to 25 show lastly various stages of movement of the selection system according to FIG. 21. FIG. 22 shows the moment of selection, FIG. 23 a moment after a selection for knitting, FIG. 24 a moment after a selection for tuck, and FIG. 25 a moment after a selection for miss.

The knitting needle 5 can also be given an additional sinking throw or stroke independent of the rotation of the cam disc in the constructional forms according to FIGS. 20 to 25, by the distance between the extension 118 formed as the drawing-down portion and the higher part of the step 128 being made sufficiently larger than the distance between the upper edge of the butt 136 and the lower edge of the butt 117 of the rod 115.

A special advantage of the constructional forms according to FIGS. 9 to 17 and 21 to 25 consists in that the coupling element (the rod 115) is also controlled in the coupling position provided for tucking and therefore operates reliably even at high speeds of rotation.

In the constructional forms described so far, all the coupling elements are first brought into the uncoupling position during the drawing-down throw and then brought out of this position into one of the two coupling positions, according to pattern. There is described hereinafter, with reference to FIGS. 26 to 31, a constructional form in which the coupling elements are first brought into the coupling position and then out of this position into the uncoupling position according to pattern.

Like the constructional form according to FIG. 18, the constructional form according to FIGS. 26 to 31 includes a driving element 12, the connecting web 16 of which is guided in a sliding bearing 107 and the arm 14 of which carries a pivot or swivel bearing 109 in which a rod 110 acting as a coupling element is mounted to pivot or swing, but so that it is axially immovable, while a pressure-applying spring 111 acts on the rod 110. The rod 110 can be applied against the holding magnet 33 in opposition to the force of the pressure-applying spring 111 and has a recess 141 the lower edge of which acts as a raising portion 142 and the upper edge of which acts as a drawing-down portion 143 (see FIG. 29), the raising portion 142 co-operating with a corresponding raising means 145 and the drawing-down portion 143 with a corresponding drawing-down means 146 of the knitting needle 5 and the arrangement being such that the drawing-down means 146 is overlapped by the drawing-down portion 143 in every position of the rod 110.

Attached to the lower part of the rod is a spring 147 which extends into the space between the rod 110 and the cam disc 10 and co-operates with the cam disc 10. In FIGS. 29 to 31, the relaxed position of the spring 147 is indicated in each case by a dashed line.

Figure 26:
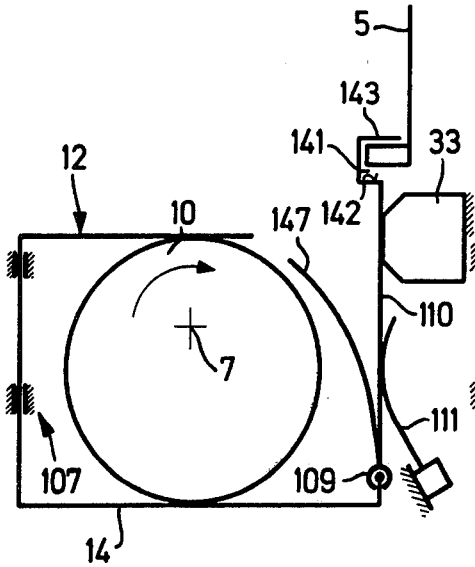
Figure 27:
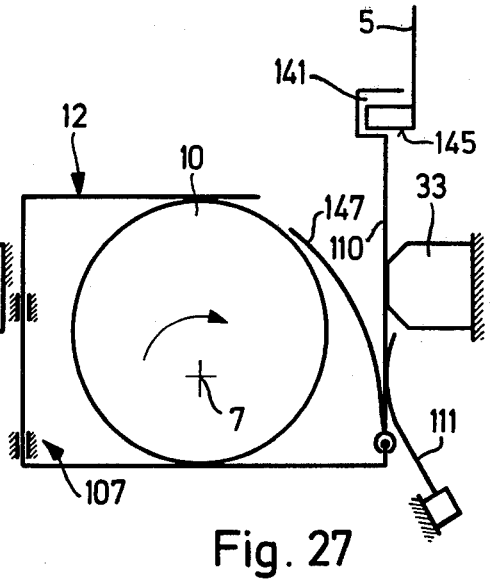
Figure 28:
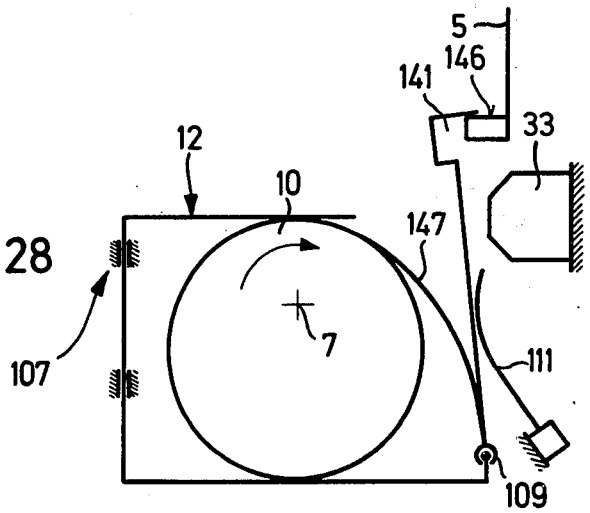

The mode of operation of this constructional form is as follows:

In the position of the cam disc 10 which can be seen in FIG. 26, for example, the rod 110 is attracted by the holding magnet 33, so that during the following raising throw the knitting needle 5 is raised into the knitting position (see FIG. 27). During the following drawing-down throw, the cam disc 10 applies itself against the spring 147, as a result of which this is first tensioned and then relaxed again. If no control signal is supplied during the drawing-down throw to the holding magnet 33, which is in the form of a permanent magnet with a control winding, the position according to FIG. 26 is obtained again after completion of the drawing-down throw, so that the knitting needle is raised again.

If the knitting needle 5 is to remain in the normal runthrough position, a control signal is applied to the control winding of the holding magnet 33 (FIG. 28) when the cam disc 10 has almost completed the drawing-down throw or when, by reason of the play between the foot 141 and the raising and drawing-down means 145 and 146, respectively, the cam disc 10 performs a small idle throw, while the sinking takes place with the aid of the sinker element 40. In consequence of the control signal, the pressure-applying spring 111 pushes the rod 110 to the left in FIG. 28 until the raising portion 142 is no longer below the raising means 145. At this instant, the spring 147 is not pre-tensioned. During the following raising throw of the cam disc 10, the knitting needle 5 remains in the normal run-through position (FIG. 29).

After completion of the raising throw, the cam disc 10 first again applies itself against the spring 147, so that the rod 110 is biased in the direction of the holding magnet 33 and the foot 141 is pushed towards the shank of the knitting needle 5. In the further course of the drawing-down throw, the foot 141 reaches the free clearance between the raising means 145 and the drawing-down means 146 (FIG. 30), so that in the last part of the drawing-down throw the coupling position which can be seen in FIG. 31 is re-established. Depending upon whether a control signal is supplied to the holding magnet 33 or not, the drawing-down throw is terminated with the coupling position which can be seen in FIG. 26 or with the uncoupling position which can be seen in FIG. 28.

As in the case of the constructional forms according to FIGS. 9 to 17 and 21 to 25, in the constructional form described with reference to FIGS. 26 to 31 a second coupling position for the raising of the knitting needle into the tucking position can be provided, it being moreover possible to use the additional control aids described with reference to the said constructional forms. Finally, in similar application of the selection system according to the invention, it would also be conceivable to make the arrangement such that during the drawing-down throw the coupling elements are first brought into that coupling position which would result in raising of the knitting needle into the tucking position, and then bring the coupling elements out of this coupling position into the uncoupling position or the other coupling position according to pattern.

The invention is not limited to the embodiments described, but can be modified in simple manner. Instead of the holding magnet 33 and the control spring 34, other devices, for example electrical, magnetic, pneumatic, hydraulic and, in particular, also mechanical devices, such as pawls or detents, etc., may be provided for holding the various coupling elements in the desired positions. The articulated connections shown in FIGS. 19 to 25 between the knitting needle 5 and the coupling elements may be replaced by other elements, in particular thin, resilient elements. The constructional form according to FIG. 21 can be modified so that when the beak on the control spring is applied against the step of the guide fork it is subjected to a tensile stress and is applied against the holding magnet 33 by a projection of the guide fork. Furthermore, the guide fork need not be located on the extension of the axis of the needle, but may arranged off-set with respect to this axis and co-operate with a bent projection or extension of the rod 115. The constructional forms according to FIGS. 9 to 16 and according to FIGS. 19 and 20 may be combined in that, in the constructional form according to FIGS. 9 to 16, there is employed as coupling element a rod connected to the knitting needle and arranged on the side of the free ends of the arms 14 and 15. Instead of a single control spring 34 which co-operates with the steps 96, the arms 101 and 102 or the step 129, two control springs controlled by two holding magnets 33 could be provided. In the constructional form according to FIG. 19, tuck selection may be rendered possible in that the butt 117 includes a step, while in an extension of the rod 115 below the butt 117 there is located another step co-operating with the control spring 34. Finally, coupling elements may be provided which are arranged in the region of the free ends of the arms 14 and 15 of the driving elements 12 in a similar manner to the rods 110 of FIG. 18 or the rods 115 of FIG. 19, but are fixedly connected neither to the knitting needle 5 nor to the driving element 12, but can be swung about a fixed pivot point in the plane of the cam discs and are controlled by means of one swing arm by the cam disc 10 or the holding magnet, and, on the other hand, act by means of their other swing arm on a swingable or bendable element located on the knitting needle. The steps 95 and 128 which can be seen in FIGS. 9 to 17 and FIGS. 21 to 25, respectively, may be provided on the knitting needle 5 instead of on the driving element 12.

Moreover, in the constructional forms according to FIGS. 9 to 31, the starting point is that it is expedient to employ the cam disc 10 both for producing the raising and drawing-down throws and for shifting the coupling elements in a defined direction. It is within the scope of the invention, however, to employ two different cam discs synchronized in movement for these two kinds of movement, one producing only the raising and drawing-down throws and the other only the shifting or swinging of the coupling element.

Furthermore, the swinging of the coupling element may be effected by magnetic or electrical means and, moreover, by patterning wheels which roll on the coupling elements, or with the aid of cams or similar elements which run from coupling element to coupling element like the sinker elements.

As holding magnet there may be employed a permanent magnet whose pole piece attracting the control spring has wound around it a control coil to which control signals are supplied according to pattern, these control signals weakening, compensating or reversing the polarity of the magnet field developed by the permanent magnet, so that the initially tensioned control spring can no longer be held. If it is felt to be a disadvantage (for example, in the constructional forms according to FIGS. 18 to 20) that in the event of a power failure there is no knitting with all the needles, the holding magnet may be in the form of a pure electromagnet to which control signals are supplied only when the control spring is to adhere to its pole face according to pattern. Instead of the holding magnet and control spring combination, an active, self-deforming element may be employed, for example a piezoelectric bending element, a magnetostrictive bending element or an electrically heated bimetallic element.

The holding magnets must be so triggered in accordance with the undulatory translational movement of the knitting wave, which is indicated in FIG. 1 by a correspondingly varying raising height of the various knitting needles, that on the one hand the triggering of the holding magnets takes place successively within a system, i.e. within a wave, and on the other hand the holding magnets of all knitting needles of the same phase are triggered at the same time. It follows from this that with single selection (knit and miss) as many control signals as there are waves are required per cycle, while with double selection (knit, tuck and miss) twice as many control signals are required. Information processing is advantageously effected in that with single selection a number of control channels corresponding to the number of knitting needles per system is provided, each nth control channel acting on all the nth knitting needles of each system and the individual control channels being triggered in succession with the aid of code discs which, for example, are mounted on the driving shaft. The triggering of another set of control channels for tucking may be effected with the aid of another code disc, which is staggered on the driving shaft relative to the first code disc by such an angle of rotation as is required to allow the beak provided on the control spring, for example according to FIG. 9 or FIG. 21, to engage in that part of the step 96 or 129 which is provided for tucking.

If mechanical selection is carried out, the control information may be stored on information tracks of an information carrier, for example in the form of cams. To distinguish between knit, tuck and miss, the cams may be arranged with different phase positions or with different heights or in different information tracks. Combinations of these features are likewise possible.

The invention may also be carried into effect in a circular knitting machine (see, for example, German Laid-open Pat. No. 1,008,438) or in other loop-forming machines, for example hosiery machines, instead of in a flat knitting machine.

What we claim is:

1. A machine for producing loop fabrics, comprising: at least one bed; a plurality of knitting tools movably mounted in said bed; a driving shaft; means for rotatingly mounting said driving shaft in said bed; at least two adjoining sleeves being mounted rotationally fast but axially slidable on said shaft, a gap being provided between said at least two sleeves; a plurality of eccentric cam means which are arranged with an angular staggered relationship and mounted on said sleeves rotationally fast therewith and axially unslidable thereon; and a plurality of means for drivingly connecting said cam means with said knitting tools for knitting purposes during rotation of said driving shaft and said sleeves.

2. A machine according to claim 1, further including recesses for accomodating an additional bearing for said driving shaft said recesses being provided in the adjoining ends of said at least two sleeves, said bearing having two parts, one part being secured to the adjoining ends of said sleeves and said other part being secured to a fixed part of the machine by means of an anchoring means extending through said gap.

3. A machine according to claim 1, further including a plurality of spacing plates mounted on said sleeves for spacing said cam means.

4. A machine according to claim 2, further including a plurality of spacing plates mounted on said sleeves for spacing said cam means, wherein said spacing plate in the gap between said sleeves is replaced by said anchoring means.

5. A knitting machine, comprising: at least one bed; a plurality of knitting tools movably mounted in said bed; a driving shaft rotatingly mounted in said bed; a plurality of eccentric cam means which are arranged on said driving shaft; a plurality of driving means, each driving means being drivingly coupled with an associated cam means; coupling means for selectively and drivingly coupling and uncoupling said knitting tools and associated ones of said driving elements for moving said tools in at least two opposite directions during rotation of said driving shaft; at least one control device having at least two control states for controlling said coupling means for coupling and uncoupling purposes; and means for moving said tools which have been moved in said one direction in another direction irrespective of the instantaneous control state of said control device, said another direction being substantially opposite to said one direction.

6. A knitting machine for producing fabrics in accordance with a pattern, comprising: at least one bed; at least one knitting tool which is movably mounted in said bed; at least one eccentric cam disc which is rotatingly mounted in said bed; at least one driving element being permanently drivingly coupled with and alternatingly movable by said cam disc in at least a first and a second opposite direction; at least one movable coupling element which may drivingly couple said driving element and said knitting tool for raising said knitting tool during movement of said driving element in said first direction; means for moving said coupling element in the time intervals between each two movements of said driving element in said first direction first into a first position and then in accordance with said pattern, holding said coupling element in said position or moving it into at least a second position such that said knitting tool during movement of said associated driving element in said first direction is not drivingly coupled with said driving element in one of said positions but drivingly coupled with said associated driving element in said other positions; and means for drawing down said knitting tool during movement of said driving element in said second direction if said knitting tool has been raised during the preceding movement of said driving element in said first direction.

7. A knitting machine for producing fabrics in accordance with a pattern comprising: at least one bed; a plurality of knitting tools which are movably mounted in said bed; a driving shaft being rotatingly mounted in said bed; a plurality of eccentric cam discs which are arranged with an angular staggered relationship on said driving shaft; a plurality of driving elements, each driving element being permanently drivingly coupled with and alternatingly moved by an associated one of said cam discs in at least a first and a second, opposite direction during rotation of said cam shaft; a plurality of movable coupling elements, wherein each coupling element may drivingly couple an associated one of said driving elements and an associated one of said knitting tools for raising said associated knitting tool during movement of said associated driving element in said first direction; means for moving each coupling element in the time intervals between each two movements of said associated driving element in said first direction first into a first position and then in accordance with said pattern holding said coupling element in said position or moving it into at least a second position such that said associated knitting tool during movement of said associated driving element in said one direction is not drivingly coupled with said driving element in one of said positions and drivingly coupled with said associated driving element in said other positions and means for drawing down said knitting tools during movement of said associated driving elements in said second direction if said knitting tools have been raised during the preceding movement of said associated driving elements in said first direction.

8. A knitting machine for producing fabrics in accordance with a pattern, comprising: at least one needle bed; a plurality of knitting tools which are movably mounted in said bed; a driving shaft being rotatingly mounted in said bed; a plurality of eccentric cam discs which are arranged with an angular staggered relationship on said driving shaft; a plurality of driving elements, each driving element being permanently drivingly coupled with and alternatingly moved by an associated one of said cam discs in at least a first and a second, opposite direction during rotation of said cam shaft; a plurality of movable coupling elements, wherein each coupling element may drivingly couple an associated one of said driving elements and an associated one of said knitting tools for raising said knitting tool during movement of said associated driving element in said first direction; means for moving each coupling element in the time intervals between each two movements of said associated driving element in said first direction first into a first position and then in accordance with said pattern holding said coupling element in said position or moving it into one of two other positions such that said associated knitting tool during movement of said knitting associated driving element in said one direction is not drivingly coupled with said associated driving element in one of said three positions but drivingly coupled with said associated driving element in said other of said three positions; and means for drawing down said knitting tools during movement of said associated driving elements in said second direction if said knitting tools have been raised during the preceding movement of said associated driving element in said first direction.

9. A machine according to claim 7, wherein said means for moving said coupling elements include said associated cam discs.

10. A knitting machine for producing fabrics in accordance with a pattern, comprising: at least one bed; a plurality of knitting tools being movably mounted in said bed; a driving shaft being rotatingly mounted in said bed; a plurality of eccentric cam discs being arranged with an angular staggered relationship on said driving shaft and having substantially the same diameter in every angular position; a plurality of driving elements, each driving element having two arms substantially parallel to each other and spaced from each other by a distance corresponding to said diameter of said cam discs, one of said arms being a raising arm and one of said arms being a drawing-down arm, wherein each cam disc is rotatingly mounted between both arms of an associated driving element such that both arms of said associated driving element bear from opposite sides against said associated cam disc in every angular position of said driving shaft and that each driving element is drivingly coupled with and alternatingly moved by said associated cam disc in at least a first and a second opposite direction during rotation of said driving shaft; a plurality of movable coupling elements, wherein each coupling element may drivingly couple an associated one of said driving elements and an associated one of said knitting tools for raising said knitting tool during movement of said associated driving element in said first direction; means for moving each coupling element in the time intervals between each two movements of said associated driving element in said first direction, first into a first position and then in accordance with said pattern, holding said coupling element in said position or moving it into one of two other positions such that said associated knitting tool during movement of said associated driving element in said one direction is not drivingly coupled with said associated driving element in one of said three positions but drivingly coupled with said associated driving element in the other of said three positions; and means for drawing-down said knitting tools during movement of said associated driving elements in said second direction if said knitting tools have been raised during the preceding movement of said associated driving element in said first direction.

11. A knitting machine for producing fabrics in accordance with a pattern, comprising: at least one bed; a plurality of knitting tools which are movably mounted in said bed, each knitting tool having a raising element and a drawing-down element; a driving shaft being rotatingly mounted in said bed; a plurality of eccentric cam discs which are arranged with an angular staggered relationship on said driving shaft; a plurality of driving elements, each driving element having a raising portion for cooperation with one of said raising elements and a drawing-down portion for cooperation with one of said drawing-down elements and being permanently drivingly coupled with and alternatingly moved by an associated one of said cam discs in at least a first and a second opposite direction during rotation of said cam shaft; a plurality of movable coupling elements, each coupling element being drivingly coupled to an associated one of said driving elements; means for moving each coupling element in the time intervals between each two movements of said associated driving element in said first direction first into a first position and then in accordance with said pattern holding said coupling element in said position or moving it into at least one further position such that said raising element of said associated knitting tool is not drivingly coupled with said raising portion of said associated driving element in one of said positions but is drivingly coupled with said raising portion of said associated driving element in the other of said positions for raising said associated knitting tool during movement of said associated driving element in said first direction; and drawing-down means including said drawing-down elements and said drawing-down portions for drawing-down said knitting tools during movement of said associated driving elements in said second direction if said knitting tools have been raised during the preceding movement of said associated driving elements in said first direction.

12. A machine according to claim 11, wherein said coupling elements are rigidly connected to said driving elements.

13. A machine according to claim 11, wherein said coupling elements are articulated to said driving elements.

14. A knitting machine for producing fabrics in accordance with a pattern, comprising: at least one bed; a plurality of knitting tools which are movably mounted in said bed, each knitting tool having a raising element and a drawing-down element; a driving shaft being rotatingly mounted in said bed; a plurality of eccentric cam discs which are arranged with an angular staggered relationship on said driving shaft; a plurality of driving elements, each driving element having a drawing-down portion for cooperation with one of said drawing-down elements and being permanently drivingly coupled with and alternatingly moved by an associated one of said cam discs in at least a first and a second opposite direction during rotation of said cam shaft; a plurality of movable coupling elements, each coupling element being drivingly coupled to an associated one of said driving elements and having a raising portion which may be coupled with said raising element of an associated one of said knitting tools during movement of said associated driving element in said first direction, for raising said associated knitting tool; means for moving each coupling element in the time intervals between each two movements of said associated driving element in said first direction first into a first position and then in accordance with said pattern holding said coupling element in said position or moving it into at least one further position such that said raising element of said associated knitting tool is not drivingly coupled with said raising portion of said associated coupling element in one of said positions but is drivingly coupled with said raising portion of said associated coupling element in the other of said positions; and drawing-down means including said drawing-down elements and said drawing-down portions for drawing-down said knitting tools during movement of said associated driving elements in said second direction if said knitting tools have been raised during the preceding movement of said associated driving elements in said first direction.

15. A knitting machine for producing fabrics in accordance with a pattern, comprising: at least one bed; a plurality of knitting tools which are movably mounted in said bed, each knitting tool having a raising element and a drawing-down element; a driving shaft being rotatingly mounted in said bed; a plurality of eccentric cam discs which are arranged with an angular staggered relationship on said driving shaft; a plurality of driving elements, each driving element being permanently drivingly coupled with and alternatingly moved by an associated one of said cam discs in at least a first and a second opposite direction during rotation of said cam shaft; a plurality of movable coupling elements, each coupling element being drivingly coupled to an associated one of said driving elements and having a raising portion for cooperation with one of said raising elements and a drawing-down portion for cooperation with one of said drawing-down elements, wherein each raising portion may be coupled with a raising element of an associated one of said knitting tools during movement of said associated driving element in said first direction for raising said associated knitting tool; means for moving each coupling element in the time intervals between each two movements of said associated driving element in said first direction first into a first position and then in accordance with said pattern holding said coupling element in said position or moving it into at least one further position such that said raising element of said associated knitting tool is not drivingly coupled with said raising portion of said associated coupling element in one of said positions but is drivingly coupled with said raising portion of said associated coupling element in the other of said positions; and drawing-down means including said drawing-down elements and said drawing-down portions for drawing-down said knitting tools during movement of said associated driving elements in said second direction if said knitting tools have been raised during the preceding movement of said associated driving elements in said first direction.

16. A knitting machine for producing fabrics in accordance with a pattern, comprising: at least one bed; a plurality of knitting tools which are movably mounted in said bed; a driving shaft being rotatingly mounted in said bed; a plurality of eccentric cam discs which are arranged with an angular staggered relationship on said driving shaft; a plurality of driving elements, each driving element having a raising portion and a drawing-down portion and being permanently drivingly coupled with and alternatingly moved by an associated one of said cam discs in at least a first and a second opposite direction during rotation of said cam shaft; a plurality of movable coupling elements, each coupling element being drivingly coupled to an associated one of said knitting tools and having a raising element for cooperation with one of said raising portions and a drawing-down element for cooperation with one of said drawing-down portions, wherein each raising element may be coupled with a raising portion of an associated one of said driving elements during movement of said associated driving element in said first direction for raising said associated knitting tool; means for moving each coupling element in the time intervals between each two movements of said associated driving element in said first direction first into a position and then in accordance with said pattern holding said coupling element in said position or moving it into at least one further positions such that said raising element of said coupling element is not drivingly coupled with said raising portion of said associated driving element in one of said positions but drivingly coupled with said raising portion of said associated driving element in the other of said positions; and drawing-down means including said drawing-down elements and said drawing-down portions for drawing-down said knitting tools during movement of said associated driving elements in said second direction of said knitting tools have been raised during the preceding movement of said associated driving elements in said first direction.

17. A knitting machine for producing fabrics in accordance with a pattern, comprising: at least one bed; a plurality of knitting tools which are movably mounted in said bed, each knitting tool having a drawing-down element; a driving shaft being rotatingly mounted in said bed; a plurality of eccentric cam discs which are arranged with an angular staggered relationship on said driving shaft; a plurality of driving elements, each driving element having a raising portion and a drawing-down portion for cooperation with one of said drawing-down elements and being permanently drivingly coupled with and alternatingly moved by an associated one of said cam discs in at least a first and a second opposite direction during rotation of said cam shaft; a plurality of movable coupling elements being drivingly coupled to an associated one of said knitting tools and having a raising element for cooperation with one of said raising portions, wherein each raising element may be drivingly coupled with a raising portion of an associated one of said driving elements for raising said associated knitting tool during movement of said associated driving element in said first direction; means for moving each coupling element in the time intervals between each two movements of said associated driving element in said first direction first into a first position and then in accordance with said pattern holding said coupling element in said position or moving it into at least one further position such that said raising element of said coupling element is not drivingly coupled with said raising portion of said associated driving element in one of said positions but drivingly coupled with said raising portion of said associated driving element in the other said position; and drawing-down means including said drawing-down elements and said drawing-down portions for drawing-down said knitting tools during movement of said associated driving elements in said second direction if said knitting tools have been raised during the preceding movement of said associated driving elements in said first direction.

18. A knitting machine for producing fabrics in accordance with a pattern, comprising: at least one bed; a plurality of knitting tools which are movably mounted in said bed, each knitting tool having a raising element and a drawing-down element; a driving shaft being rotatingly mounted in said bed; a plurality of eccentric cam discs which are arranged with an angular staggered relationship on said driving shaft; a plurality of driving elements, each driving element having a raising portion for cooperation with one of said raising elements and a drawing-down portion for cooperation with one of said drawing-down elements and being permanently drivingly coupled with and alternatingly moved by an associated one of said cam discs in at least a first and a second opposite direction during rotation of said cam shaft; a plurality of movable coupling elements for drivingly coupling each raising portion of said driving elements with a raising element of an associated one of said knitting tools during movement of said associated driving element in said first direction for raising said associated knitting tool; means for moving each coupling element in the time intervals between each two movements of said associated driving element in said first direction first into a first position and then in accordance with said pattern holding said coupling element in said position or moving it into at least one further position such that said raising element of said associated knitting tool is not drivingly coupled with said raising portion of said associated driving element in one of said positions but is drivingly coupled with said raising portion of said associated driving element in the other of said positions; and drawing-down means including said drawing-down elements and said drawing-down portions for drawing-down said knitting tools during movement of said associated driving elements in said second direction if said knitting tools have been raised during the preceding movement of said associated driving elements in said first direction.

19. A machine for producing loop fabrics, comprising: at least one bed; a plurality of knitting tools movably mounted in said bed; a driving shaft being rotatingly mounted in said bed; means for rotatingly mounting said shaft at both ends thereof; a plurality of eccentric cam means which are arranged with an angular staggered and closely spaced relationship on said driving shaft throughout the length and between the ends thereof; a plurality of means for drivingly connecting said cam means with said knitting tools for knitting purposes during rotation of said driving shaft; at least one thin spacing plate being provided between at least two of said cam means on said driving shaft; and means for mounting said spacing plate for additionally supporting said driving shaft at a location between said ends.

20. A machine according to claim 19 having a plurality of spacing plates, each spacing plate being provided between two of said cam means.

21. A knitting machine for producing a fabric in accordance with a pattern, comprising: at least one bed; a plurality of eccentric cam means which are rotatingly mounted and arranged in said bed with an angular staggered relationship; means for rotating said cam means during a plurality of revolutions; a plurality of knitting tools movably mounted in said bed, which knitting tools may during a first half of each of said revolutions selectively be moved from a first position into a second position or left in said first position and wherein each knitting tool, which has been selected, may be moved back during a second half of each of said revolutions into said first position; a plurality of driving means, each driving means being associated to one of said knitting tools and drivingly coupled with an associated one of said cam means; said knitting tools being, if selected, drivingly coupled and, if not selected, not drivingly coupled with said associated driving means during each first half of said revolutions such that only said selected knitting tools are moved into said second positions by said associated driving means; means for selecting or leaving unselected said knitting tools during each of said revolutions; means for drivingly coupling said selected knitting tools and said associated driving means and for uncoupling or leaving uncoupled said not selected knitting tools and said associated driving means substantially during each second half of said revolutions; and means for moving back from said second positions into said first positions and for leaving in said first positions said unselected knitting tools substantially during said second half of each of said revolutions.

22. A knitting machine for producing a fabric in accordance with a pattern, comprising: at least one bed; a plurality of eccentric cam means which are rotatingly mounted and arranged in said bed with an angular staggered relationship; means for rotating each cam means during a plurality of revolutions; a plurality of knitting tools movably mounted in said bed, which knitting tools may during a first half of each of said revolutions selectively be moved from a first position into one of two further positions or left in said first position and wherein each knitting tool, which has been selected, may be moved back during a second half of each of said revolutions into said first position; a plurality of driving means, each driving means being associated to one of said knitting tools and drivingly coupled with an associated one of said cam means; said knitting tools being, if selected, drivingly coupled and, if not selected, not drivingly coupled with said associated driving means during each first half of said revolutions such that only said selected knitting tools are moved into one of said further positions by said associated driving means; means for selecting or leaving unselected said knitting tools during each of said revolutions; means for drivingly coupling said selected knitting tools and said associated driving means and for uncoupling or leaving uncoupled said not selected knitting tools and said associated driving means substantially during each second half of said revolutions; and means for moving back from one of said further positions into said first positions and for leaving in said first positions said unselected knitting tools substantially during said second half of each of said revolutions.

23. A machine according to claim 7, wherein said cam discs are of substantially the same thickness or diameter in every angular position.

24. A machine according to claim 7, wherein said driving elements have two arms which are spaced apart in said two directions and bear against opposite sides of said associated cam discs in every angular position of the driving shaft.

25. A machine according to claim 24, wherein said driving elements consist of a fork having a connecting web connecting said arms, said connecting web being guided in a fixed sliding bearing arranged parallel to said opposite directions.

26. A machine according to claim 10, wherein said coupling elements are swingably mounted rods.

27. A machine according to claim 26, wherein each rod is swingably connected to an associated driving element.

28. A machine according to claim 27, wherein each tool has a raising element and each rod has a raising portion co-operating with said raising element of an associated knitting tool.

29. A machine according to claim 26, wherein each rod is swingably connected to an associated knitting tool.

30. A machine according to claim 29, wherein each rod has a raising element co-operating with said raising arm of said associated driving element.

31. A machine according to claim 29, wherein each rod is arranged near said associated driving element so that it can be swung into said first position after completion of each movement of said associated driving element in said first direction, in which first position said raising portion is outside the effective range of said raising arm, and can be swung back into one of said other positions according to said pattern before commencement of the following movement of said associated driving element in said first direction.

32. A machine according to claim 27, wherein each knitting tool has a drawing-down element co-operating with said drawing-down arm of said associated driving element.

33. A machine according to claim 29, wherein each rod has a drawing-down element co-operating with the drawing-down arm of said associated driving element.

34. A machine according to claim 26, and comprising a control device wherein each rod is biased in the direction of one of said positions by means of a spring and can be held in said other positions by means of said control device in opposition to the force of said spring.

35. A machine according to claim 29, wherein the free end of each rod is mounted to be longitudinally slidable in an associated swingably mounted guide fork.

36. A machine according to claim 35, and comprising a control device, wherein each guide fork is biased by a spring such that each associated rod is biased in the direction of one of said positions and can be held in said other position by means of said control device acting on said guide fork in opposition to the force of said spring.

37. A machine according to claim 28, wherein each raising element has a step, one part of which causes the raising of said associated knitting tool to a first position and the other part of which causes the raising of said associated tool to a second position, and wherein said rod is controllable into said coupling positions for selectively coupling said raising portion with one of two steps.

38. A machine according to claim 28, wherein each raising portion has a step, one part of which causes the raising of said associated knitting tool to a first position and the other part of which causes the raising of said associated tool to a second position, and wherein said rod is controllable into two coupling positions for selectively coupling said raising element with one of said steps.

39. A machine according to claim 30, wherein each raising element has a step, one part of which causes the raising of said associated knitting tool to a first position and the other part of which causes the raising of said associated tool to a second position, and wherein said rod is controllable into two coupling positions for selectively coupling said raising arm with one of said steps.

40. A machine according to claim 30, wherein each raising arm has a step one part of which causes the raising of said associated knitting tool to a first position and the other part of which causes the raising of said associated knitting tool to a second position, and wherein said rod is controllable into two coupling positions for selectively coupling said raising element with one of said steps.

41. A machine according to claim 10 and comprising a control device having a plurality of controllable holding magnets, each holding magnet being associated with one of said coupling elements.

42. A machine according to claim 26, and comprising a control device having a plurality of controllable holding magnets, each holding magnet being associated with one of said rods, each rod being held by said associated holding magnet in one of said positions in accordance with said pattern.

43. A machine according to claim 35, and comprising a control device having a plurality of controllable holding magnets, each holding magnet being associated with a guide fork, each guide fork being held by said associated holding magnet in one of at least two positions in accordance with said pattern.

44. A machine according to claim 41, wherein said control device has a plurality of control springs, each spring being adapted to be applied against an associated holding magnet by resilient bending, and each spring, on being applied against said holding magnet, causing said coupling element to move into one of said positions, while on being released according to said pattern by the holding magnet arrests said coupling element in one of its two other positions.

45. A machine according to claim 44, wherein each control spring is so coupled with said associated driving element that it is applied against said holding magnet during movement of said driving element in said first direction.

46. A machine according to claim 35, wherein said control device includes a plurality of control springs, each control spring being associated with one of said guide forks and adapted to be applied against an associated holding magnet by resilient bending and each control spring further having a beak and each guide fork having a step with two parts so that, when a control spring is applied against an associated holding magnet, it causes said associated rod to swing into one of said positions and when it is released according to said pattern by said holding magnet it is applied by means of its beak against one part of said step, so that said rod is arrested in one of said other positions.

47. A machine according to claim 10, wherein each coupling element is a structural part of and rigidly connected to an associated driving element.

48. A machine according to claim 47, wherein each coupling element has a connecting web connecting said arms of an associated driving element and being so biased towards said associated cam disc by the force of a spring that during the movement of said driving element in said second direction it is first shifted by said associated cam disc into one of said positions in a direction deviating from said two directions and can then be shifted back according to said pattern into one of said two other positions by said spring.

49. A machine according to claim 47, wherein to each driving element a shank is rigidly connected, the free end of which is mounted in a stationary sliding and pivot bearing.

50. A machine according to claim 47, wherein each driving element is mounted slidably and rotatably in a spring fixed to the machine.

51. A machine according to claim 48, wherein each knitting tool has a drawing-down element which can be brought into engagement with the drawing-down arm of said associated driving element in any of said positions of said connecting web.

52. A machine according to claim 51, wherein said drawing-down element is the upper edge of a butt which is overlapped in any of said positions of said associated connecting web by the lower edge of a projection provided on said associated driving element.

53. A machine according to claim 48, wherein each knitting tool has a raising element co-operating with the raising arm of said associated driving element.

54. A machine according to claim 53, wherein each raising element is the lower edge of a butt which is overlapped by the upper edge of a projection provided on said associated driving element in dependence upon said positions of said associated connecting web.

55. A machine according to claim 54, wherein the raising arm of each driving element has a step, one part of which produces the raising of the said associated knitting tool to a first position and the other part of which produces the raising of said associated knitting tool to a second position.

56. A machine according to claim 55, wherein each connecting web is so movable according to said pattern into two positions that said raising element of said associated knitting tool is coupled selectively to said raising arm of said associated driving element by one of said two parts of said step.

57. A machine according to claim 53, wherein each raising element has a step, one part of which produces the raising of said associated knitting tool to a first position and the other part of which produces the raising of said associated knitting tool to a second position.

58. A machine according to claim 57, wherein each connecting web is movable according to said pattern into two positions so that said raising element of said associated knitting tool is coupled selectively to said raising arm of said associated driving element by one of said two parts of said step.

59. A machine according to claim 47, and comprising a control device having a plurality of controllable holding magnets and a plurality of control springs, each spring being adapted to be applied against an associated magnet by resilient bending and, on being applied against said associated holding magnet, causes a connecting web of an associated driving element to swing into one of said positions, while on being released according to said pattern by said associated holding magnet arrests said connecting web in another one of its positions.

60. A machine according to claim 59, wherein to each driving element a shank is rigidly connected, the free end of which is mounted in a stationary sliding and pivot bearing, and wherein on each shank there is provided a projection which applies said associated control spring against said holding magnet during the movement of said driving element into said one of said directions.

61. A machine according to claim 60, wherein each control spring has a beak and each shank has a step with two parts and, when a control spring is applied against an associated holding magnet, it causes an associated connecting web to swing into one of its positions and when it is released according to said pattern by said holding magnet it is applied by means of its beak against one part of said step, so that said associated connecting web is arrested according to said pattern in one of said other positions.

62. A machine according to claim 60, wherein each spring bears against the outer free end of said shank.

63. A machine according to claim 60, wherein each shank is mounted on that side of said associated driving element which is opposite said arms.

64. A machine according to claim 49, wherein each sliding and pivot bearing has two conical bearings facing one another and between which said shank is arranged.

65. A machine according to claim 49, wherein each sliding and pivot bearing is formed by a pivot extending into a slot.

66. A machine according to claim 49, wherein each sliding and pivot bearing is arranged outside the axis of said associated knitting tool or its extension.

67. A machine according to claim 47, wherein each sliding and pivot bearing is arranged approximately on the extension of the axis of said associated loop forming tool.

68. A machine according to claim 19, wherein said spacing plate consists of two portions which embrace said driving shaft on diametrically opposite sides and are fixed to a stationary part of the machine.

69. A machine according to claim 19, wherein spacing plates are provided between each two cam means.

70. A machine according to claim 19, wherein said spacing plate is circular and is held in bearings at its periphery, said bearings being fixed to a part of the machine.

71. A machine according to claim 70, wherein said bearings consist of bearing plates.

72. A machine according to claim 70, wherein the envelope circle diameter of said spacing plate is larger than the envelope circle diameter of said cam means.

73. A machine according to claim 70, wherein said bearings are in the form of plain bearings extending over the width of the machine.

74. A machine according to claim 70, wherein said bearings consist of at least three rolling bearings extending over the width of the machine, said bearings rolling on the periphery of said spacing plate at different locations.

75. A machine according to claim 1, wherein the driving coupling between said knitting tools and said driving elements has some play and wherein said additional movement corresponds to a preselected portion of said play.

76. A machine according to claim 10, wherein said machine is a flat knitting machine, and said bed is a needle bed.

77. A machine according to claim 76, wherein said first position of said knitting tools is a knitting height and said second position of said knitting tools is a tuck height.

78. A machine according to claim 27, wherein each rod is mounted on an extension formed as a pivot bearing on said raising arm of said associated driving element and wherein said means for moving said coupling elements include said associated cam discs for swinging said rods into one of said positions between each two movements of said associated driving element in said first direction.

79. A machine according to claim 78, wherein said means for moving said coupling elements include spring means for transmitting force from each cam disc to each associated rod.

80. A machine according to claim 10, wherein said knitting tools have butt means, and further including at least one cam device movable along said bed at a level substantially corresponding to the level of said butt means when said knitting tools have been drawn-down by said drawing-down means, said cam devices having cam means acting on said butt means for superposing an additional movement to the movement of said knitting tools caused by said drawing-down means.

* * * * *